US007073883B2

(12) United States Patent
Billow

(10) Patent No.: US 7,073,883 B2
(45) Date of Patent: Jul. 11, 2006

(54) METHOD OF ALIGNING INKJET NOZZLE BANKS FOR AN INKJET PRINTER

(75) Inventor: Steven A. Billow, Victor, NY (US)

(73) Assignee: Eastman Kodak Company, Rochester, NY (US)

( * ) Notice: Subject to any disclaimer, the term of this patent is extended or adjusted under 35 U.S.C. 154(b) by 265 days.

(21) Appl. No.: 10/686,696

(22) Filed: Oct. 16, 2003

(65) Prior Publication Data

US 2005/0083364 A1 Apr. 21, 2005

(51) Int. Cl.
*B41J 29/393* (2006.01)
*B41J 2/15* (2006.01)
*B41J 2/145* (2006.01)

(52) U.S. Cl. ..... 347/19; 347/41

(58) Field of Classification Search ..... 347/8–9, 347/12, 19, 37

See application file for complete search history.

(56) References Cited

U.S. PATENT DOCUMENTS

| | | | | |
|---|---|---|---|---|
| 4,593,295 | A | 6/1986 | Matsufuji et al. | |
| 5,250,956 | A | 10/1993 | Haselby et al. | |
| 5,451,990 | A | 9/1995 | Sorenson et al. | |
| 6,076,915 | A | 6/2000 | Gast et al. | |
| 6,109,722 | A * | 8/2000 | Underwood et al. | 347/19 |
| 6,154,230 | A | 11/2000 | Holstun et al. | |
| 6,241,334 | B1 * | 6/2001 | Haselby | 347/19 |
| 6,347,857 | B1 | 2/2002 | Purcell et al. | |
| 6,364,451 | B1 | 4/2002 | Silverbrook | |
| 6,425,652 | B1 | 7/2002 | Otsuki | |
| 6,450,607 | B1 | 9/2002 | Bolash et al. | |
| 6,454,378 | B1 | 9/2002 | Silverbrook et al. | |
| 6,464,330 | B1 | 10/2002 | Miller et al. | |
| 6,478,401 | B1 | 11/2002 | King et al. | |
| 6,685,297 | B1 * | 2/2004 | Butterfield et al. | 347/19 |

FOREIGN PATENT DOCUMENTS

| | | |
|---|---|---|
| EP | 0 934 831 A1 | 8/1999 |
| EP | 1 027 998 A2 | 8/2000 |

* cited by examiner

*Primary Examiner*—Thinh Nguyen
(74) *Attorney, Agent, or Firm*—Norman Rushefsky; Mark G. Gocchetti

(57) ABSTRACT

A method is provided for reducing image artifacts in printers that employ two or more printhead nozzle banks that must be aligned and registered with respect to each other either through adjustment of orientation and/or position of one nozzle bank relative to another or through selective control of actuation. In the method, discrete dots are printed by the nozzle banks upon a target receiver medium. Examination of the receiver medium or a reproduction thereof is made by a scanner and information regarding location of the dots is generated. From information regarding location of the dots a determination is made of error placement of the dots from ideal locations. Alignment of the nozzle banks are made in accordance with any errors determined in placement.

22 Claims, 13 Drawing Sheets

| RASTER ROW | RASTER COLUMN 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
|---|---|---|---|---|---|---|---|---|---|---|---|---|---|---|---|---|---|---|---|---|---|---|---|---|---|
| 1 | [1,147,1] | | | | | [4,449,3] | | | | | [6,600,4] | | | | | [2,298,2] | | | | | [5,600,4] | | | | |
| 2 | | | | | | | | | | | | | | | | | | | | | | | | | |
| 3 | | | | | | | | | | | | | | | | | | | | | | | | | |
| 4 | | | | | | | | | | | | | | | | | | | | | | | | | |
| 5 | | | | | | | | | | | | | | | | | | | | | | | | | |
| 6 | [2,293,2] | | | | | [1,595,4] | | | | | [1,293,2] | | | | | [5,595,4] | | | | | [6,444,3] | | | | |
| 7 | | | | | | | | | | | | | | | | | | | | | | | | | |
| 8 | | | | | | | | | | | | | | | | | | | | | | | | | |
| 9 | | | | | | | | | | | | | | | | | | | | | | | | | |
| 10 | | | | | | | | | | | | | | | | | | | | | | | | | |
| 11 | [3,137,1] | | | | | [6,288,2] | | | | | [2,137,1] | | | | | [4,288,2] | | | | | [1,137,1] | | | | |
| 12 | | | | | | | | | | | | | | | | | | | | | | | | | |
| 13 | | | | | | | | | | | | | | | | | | | | | | | | | |
| 14 | | | | | | | | | | | | | | | | | | | | | | | | | |
| 15 | | | | | | | | | | | | | | | | | | | | | | | | | |
| 16 | [4,434,3] | | | | | [3,132,1] | | | | | [3,434,3] | | | | | [1,585,4] | | | | | [2,434,3] | | | | |
| 17 | | | | | | | | | | | | | | | | | | | | | | | | | |
| 18 | | | | | | | | | | | | | | | | | | | | | | | | | |
| 19 | | | | | | | | | | | | | | | | | | | | | | | | | |
| 20 | | | | | | | | | | | | | | | | | | | | | | | | | |
| 21 | [5,580,4] | | | | | [2,429,3] | | | | | [4,127,1] | | | | | [6,429,3] | | | | | [3,127,1] | | | | |
| 22 | | | | | | | | | | | | | | | | | | | | | | | | | |
| 23 | | | | | | | | | | | | | | | | | | | | | | | | | |
| 24 | | | | | | | | | | | | | | | | | | | | | | | | | |
| 25 | | | | | | | | | | | | | | | | | | | | | | | | | |

*FIG. 15*

METHOD OF ALIGNING INKJET NOZZLE BANKS FOR AN INKJET PRINTER

FIELD OF THE INVENTION

The invention relates generally to the field of printing such as for example inkjet printing and more particularly, in the field of inkjet printing, to a method of aligning inkjet nozzle banks or modules within an inkjet printer. As broadly used herein alignment of a nozzle bank can be controlled by the adjustment of orientation and/or position of the nozzle bank as well as through selective control of actuation of respective nozzles of the nozzle bank to control proper dot placement.

BACKGROUND OF THE INVENTION

Inkjet printing is a non-impact method for producing images by the deposition of ink droplets in a pixel-by-pixel manner into an image-recording element in response to digital signals. There are various methods which may be utilized to control the deposition of ink droplets on the receiver member to yield the desired image. In one process, known as drop-on-demand inkjet printing, individual droplets are ejected as needed on to the recording medium to form the desired image. Common methods of controlling the ejection of ink droplets in drop-on-demand printing include piezoelectric transducers and thermal bubble formation using heated actuators. With regard to heated actuators, a heater placed at a convenient location within the nozzle or at the nozzle opening heats ink in selected nozzles and causes a drop to be ejected to the recording medium in those nozzle selected in accordance with image data. With respect to piezo electric actuators, piezoelectric material is used in conjunction with each nozzle and this material possesses the property such that an electrical field when applied thereto induces mechanical stresses therein causing a drop to be selectively ejected from the nozzle selected for actuation. The image data provided as signals to the printhead determines which of the nozzles are to be selected for ejection of a respective drop from each nozzle at a particular pixel location on a receiver sheet. Some drop-on-demand inkjet printers described in the patent literature use both piezoelectric actuators and heated actuators.

In another process known as continuous inkjet printing, a continuous stream of droplets is discharged from each nozzle and deflected in an imagewise controlled manner onto respective pixel locations on the surface of the recording member, while some droplets are selectively caught and prevented from reaching the recording member. Inkjet printers have found broad applications across markets ranging from the desktop document and pictorial imaging to short run printing and industrial labeling.

A typical inkjet printer reproduces an image by ejecting small drops of ink from the printhead containing an array of spaced apart nozzles, and the ink drops land on a receiver medium (typically paper, coated paper, etc.) at selected pixel locations to form round ink dots. Normally, the drops are deposited with their respective dot centers on a rectilinear grid, i.e., a raster, with equal spacing in the horizontal and vertical directions. The inkjet printers may have the capability to either produce only dots of the same size or of variable size. Ink-jet printers with the latter capability are referred to as (multitone) or gray scale ink-jet printers because they can produce multiple density tones at each selected pixel location on the page.

Inkjet printers may also be distinguished as being either pagewidth printers or swath printers. Examples of pagewidth printers are described in U.S. Pat. Nos. 6,364,451 B1 and 6,454,378 B1. As noted in these patents, the term "pagewidth printhead" refers to a printhead having a printing zone that prints one line at a time on a page, the line being parallel either to a longer edge or a shorter edge of the page. The line is printed as a whole as the page moves past the printhead and the printhead is stationary, i.e. it does not raster or traverse the page. These printheads are characterized by having a very large number of nozzles. The referenced U.S. patents disclose that should any of the nozzles of one printhead be defective the printer may include a second printhead that is provided so that selected nozzles of the second printhead substitute for defective nozzles of the primary printhead.

Today the fabrication of pagewidth inkjet printheads is relatively complex and they have not gained a broad following. In addition there are problems associated with high-resolution printing in that simultaneous placement of ink drops adjacent to each other can create coalescence of the drops resulting in an image of relatively poor quality.

Swath printers on the other hand are quite popular and relatively inexpensive as they involve significantly fewer numbers of nozzles on the printhead. In addition in using swath printing and multiple passes to print an area during each pass, dot placement may be made selectively so that adjacent drops are not deposited simultaneously or substantially simultaneously on the receiver member. There are many techniques present in the prior art that described methods of increasing the time delay between printing adjacent dots using methods referred to as "interlacing", "print masking", or "multipass printing." There are also techniques present in the prior art for reducing one-dimensional periodic artifacts or "bandings." This is achieved by advancing in a slow-scan direction the paper or other receiver medium by an increment less than the printhead width, so that successive passes or swaths of the printhead overlap. The techniques of print masking and swath overlapping are typically combined. The term "print masking" generally means printing subsets of the image pixels in multiple passes of the printhead relative to a receiver medium. In swath printing a printhead, having a plurality of nozzles arranged in a row, is traversed in a fast-scan direction across a page to be printed. The traversal is such as to be perpendicular to the direction of arrangement of the row of nozzles.

With reference to commonly assigned U.S. Pat. No. 6,464,330 B1, filed in the names of Miller et al., an example of a printhead used in a swath printer is illustrated. The disclosure in this patent is incorporated herein by reference thereto. With reference to the accompanying FIG. 1, printhead 31 for each color of ink to be printed includes in this embodiment two printhead segments or modules or nozzle banks 39A and 39B. Each printhead nozzle bank includes two staggered rows of nozzles and the nozzles in each row of nozzles have a spacing of 1/150 inches between adjacent nozzles in the row. However, due to the presence of staggering there is a nominal nozzle pitch spacing, P, in each printhead nozzle bank of 1/300 inches as indicated in the figure. The nozzles on the second nozzle bank 39B are similar to that on the first nozzle bank 39A and the nozzle banks are arranged to continue the nozzle spacing for the printhead of 1/300 inches spacing between nozzles. The printhead nozzle banks may each also be referred to as a "nozzle module" because they are individually assembled into a supporting structure to form the printhead for printing a particular color. Each nozzle bank may also be referred to as a pen, segment or a module. Hereinafter, they will be referred to as a nozzle bank. It will be understood that for a printer having six different color inks, six printheads similar to that described for printhead 31 may be provided. The six different color printheads are arranged on a carriage that is traversed across the receiver sheet for a print pass. The nozzles in each of the six color printheads, are actuated to print with ink in their respective colors in accordance with image instructions received from a controller or image processor. Each printhead, would in the example of the subject printer, have two printhead nozzle banks.

To create pleasing printed images, the dots printed by one nozzle bank must be aligned such that dots printed by one of the nozzle banks are closely registered relative to the dots printed by the other nozzle banks jetting the same color ink. If they are not well registered, then the maximum density attainable by the printer will be compromised and banding artifacts will appear. Consider, for example a print made by a single color using a nozzle configuration as shown greatly magnified in FIG. 1, with two nozzle banks per color. As may be seen in FIG. 1, the two nozzle banks used to print each color are offset one from the other a predetermined known small distance "d" in the fast-scan direction. Such is a condition when proper registration is present and the printer adjusts the actuation or firing times of the nozzles in one nozzle tank to account for this small distance. If the nozzle banks are registered very well, it would be possible to print an image that appears as FIG. 2, with all of the paper covered by at least a single layer of ink. In this example, the image is hypothetically printed at 300 dpi using two banding passes per swath such that for printing a swath of pixels half of the dots are printed by the first nozzle bank and half of the dots are printed by the second nozzle bank. By contrast, if the two nozzle banks shown in FIG. 1 have a slight (~35 micron) misregistration in the fast-scan direction, the dots do not properly align and some white space is generated as shown in FIG. 3. Likewise, if the misregistration is in the slow-scan direction, a similar situation occurs as shown in FIG. 4. Even more troublesome is a slight, relative skew between the two nozzle banks as shown in FIG. 5. In this case, at one end of the swath, good registration of the two nozzle banks is attained. At the other end of the swath, however, poor registration is incurred and banding is observed with a period equal to the height of the swath. Even very slight misalignments can result in objectionable image artifacts.

Large physical separations between two nozzle banks can make proper alignment even more difficult. Consider the nozzle bank arrangement as described in U.S. Pat. No. 4,593,295 by Matsufuji et al. To alleviate hue differences that may result from bi-directional printing, '295 teaches a particular arrangement of nozzle banks such that the ink order is symmetric with respect to an axis that is parallel to the slow-scan direction. To maintain this symmetry, one color of ink must be jetted by the leftmost nozzle bank(s) as well as by the rightmost nozzle bank(s) as shown in FIG. 4 of '295. In a typical inkjet printer, the distance between these nozzle banks may be 15 centimeters or more. Requiring precise alignment of two sets of nozzle banks being separated by such a distance is very challenging using typical techniques.

These are just some of the ways that the image quality produced by an inkjet printer can be compromised by poor registration of the various nozzle banks. Additionally, poor registration between the color planes can result in blurry or noisy images and overall loss of detail. These problems make good registration and alignment of all the nozzle banks within an inkjet printer critical to ensure good image quality. That is, not only should a nozzle bank be well registered with another that jets the same color ink, but it should also be well registered with nozzle banks that jet ink of another color.

In addition to good image quality, faster print rates are desired by customers of inkjet printers. For swath printers, a well-known means by which to accomplish high productivities is by increasing the number of nozzles. One way in which nozzle count may be increased is by simply adding extra nozzle banks. This has the advantage that the same print head design may be used. However, this adds to the number of nozzle banks that must be aligned, thereby increasing the possibility for misalignment and the labor required to properly align all the nozzle banks.

An alternative to gain higher productivity is to increase the nozzle count within a nozzle bank. This does not increase the count of nozzle banks, but usually results in longer nozzle banks as increasing the nozzle density of a nozzle bank typically requires a completely new print head design and/or a new manufacturing process. Longer nozzle banks also increase the difficulty of alignment of the nozzle banks as the sensitivity to angular displacements increases proportionately. For instance, the misregistration represented in FIG. 5 can result from a relative angular displacement of just 0.08 degrees if the two nozzle banks depicted in FIG. 1 are each one inch in length.

In high-end inkjet printers, such as one that might be used in a wide-format application, there are other considerations that must be made to ensure proper alignment of the nozzle banks. For instance, bi-directional printing in the fast-scan direction to increase productivity requires that the nozzle banks be properly aligned whether traveling in the right-to-left direction or the left-to-right direction.

Some high-end printers accept a variety of ink-receiving materials that may differ significantly in thickness. As a result, the printer may have several allowable discrete gaps between the nozzle banks and the printer platen to accommodate these different receivers. Invariably, the gap between the nozzle banks and the top of the receiver can vary significantly because of the range of receiver thicknesses and the limited number of discrete nozzle bank heights. Due to the carriage velocity, the flight path of the drop is not straight down but really is the vector sum of the drop velocity and carriage velocity. This angular path and the differences in nozzle bank heights make nozzle bank registration sensitive to both the average of the nozzle bank heights as well as the variation in nozzle bank heights. These sensitivities further complicate the nozzle bank alignment process.

Additionally, some high-end printers allow the customer to select different carriage velocities, higher carriage velocities resulting in increased productivity usually at a price in image quality. The term "carriage velocities" implies the supporting of the printheads upon a carriage support that moves in the fast-scan direction while being supported for movement by a rail or other support. The angular flight path of the droplets described will be a function of the carriage velocity. This then makes nozzle bank alignment sensitive to yet another variable, namely carriage velocity.

Yet another complicating factor is the use of multiple drop sizes of which many new print head designs are capable. As discussed above, the alignment of the printer is a function of the combination of the carriage velocity and droplet velocity. Due to differences in drag as the droplet flies through the air, different size droplets have different droplet velocities.

Therefore, to provide good alignment, it may be desired to use different alignment settings for different drop sizes.

Current alignment techniques fall within two varieties. Visual techniques use patterns printed by the printer that permit a user to simultaneously view various alignment settings and chose the best setting (see, for example, U.S. Pat. Nos. 6,109,722 and 6,450,607). Visual techniques are disadvantaged in many ways. First, for a printer with many nozzle banks (24 separate nozzle banks is not uncommon), multiple print head heights, and multiple carriage velocities, the number of alignments can become overbearing as each variation adds multiplicatively to the rest. Secondly, only a moderate level of accuracy is attainable with most of these techniques and finely tuned printers require a higher degree of accuracy attainable by most of these techniques. The level of accuracy is further compromised between all color records by using a single color as the only reference. U.S. Pat. No. 6,450,607B1, for example, attempts to reduce this sensitivity by using the black nozzle bank as a reference for black and white images and a color nozzle bank when printing color images. For instance, a 4-color printer containing cyan, magenta, yellow and black may use cyan as the reference when printing color images. An accuracy of approximately $1/600^{th}$ of an inch is quoted using the visual techniques described within U.S. Pat. No. 6,450,607B1 meaning that yellow and magenta may still be misregistered by two times $1/600^{th}$ inch or $1/300^{th}$ inch, despite practice of the invention disclosed by '607. Thirdly, interactions can occur between the various alignment parameters, which further degrade the ultimate quality of alignment that can be obtained through these visual techniques, or multiple iterations are required, thereby increasing the labor of the effort. Lastly, since several of these techniques usually operate by providing several alignment settings to the operator who then chooses the best choice, significant amounts of consumables (ink and media) may be required to obtain satisfactory alignment of all nozzle banks in all print modes.

The second way nozzle banks are typically aligned (e.g., U.S. Pat. Nos. 5,250,956, 6,478,401B1, and 5,451,990) is with an on-carriage optical sensor that interprets patterns printed by the nozzle banks to automatically make adjustments to the nozzle bank alignment. While much improved over the more common visual techniques, these methods, too, have several shortcomings. Firstly, they require additional hardware costs for each printer as a separate optical sensor and accompanying electronics are required. Secondly, the optical sensors are typically of the LED variety with economical optics and cannot provide the high degree of accuracy required of finely tuned, high-end printers. Thirdly, these sensors require significant averaging to create a reliable signal, making the amount of receiver required to perform the alignment larger than one would desire. Furthermore, this high degree averaging necessitates a separate measurement for each nozzle bank, requiring even more ink and receiver as the number of nozzle banks increases. Fourthly, these on-carriage optical sensors are typically arranged to provide data primarily in the fast-scan direction. For demanding applications, slow-scan adjustments are equally important. Some techniques provide means by which slow-scan misalignments may be determined, but these measurements require separate, additional patterns, further consuming additional ink and receiver. The patterns in U.S. Pat. No. 6,478,401B1, for example, require slanted blocks. The accuracy of the slow-scan measurement improves as the angle is made shallower, requiring additional receiver as greater accuracy is required. Furthermore, this fast-scan limitation makes determination of nozzle bank skew very difficult or impossible (U.S. Pat. No. 5,250,956, for example, requires 8 separate measurements to ascertain nozzle bank skew and U.S. Pat. No. 6,076,915 makes no provision for measurement of skew) and, as demonstrated in FIG. 5, this is a critical alignment dimension. Another result of the fast-scan directional limitation is the inability to measure errors in the advance of the receiver, yet another critical alignment variable. Lastly, these on-line optical sensor techniques have made no provision for alignment of a nozzle bank using different drop sizes wherein each drop size may optimally require slightly different alignments.

U.S. Pat. No. 6,347,857B1 implements an on-printer detection scheme by which single, isolated droplets are analyzed to ascertain the relative health of each nozzle so that corrective or compensating action may be taken in the case of poorly performing nozzles. To maintain rapid image capture for a relatively inexpensive device, the technique uses relatively low-cost capture techniques. While effective at detecting print head performance problems, it is incapable of detecting minute alignment errors shown to be detrimental in inkjet printing using multiple nozzle banks. Furthermore, no teachings of printed patterns capable of allowing such measurements are offered as part of the invention. Additionally, the invention disclosed in U.S. Pat. No. 6,347,857B1 requires additional printer hardware and special receiver for the analysis, adding to total printer cost.

It is therefore desired to develop a nozzle bank alignment technique and process that provides a high degree of accuracy of alignment of all critical alignment variables while requiring very little labor and time to execute and while consuming as little ink and receiver as possible.

SUMMARY OF THE INVENTION

In accordance with an object of the invention, a method is provided for reducing image artifacts in printers that employ two or more printhead nozzle banks that must be aligned and registered with respect to each other either through adjustment of orientation and/or position of one nozzle bank relative to another or through selective control of actuation of respective nozzles of the one nozzle bank to control proper dot placement. Although the description herein will be with regard to a printer that employs two nozzle banks to print each color, it will be understood that the invention is equally applicable to a printer that employs one or more nozzle banks to print each color of ink.

In accordance with a first embodiment of the invention, a method of aligning the printing of dots generated by different nozzle banks of an inkjet printer apparatus comprising the steps of (a) printing on a receiver medium a sequence of spaced discrete first dots from one nozzle bank having plural nozzles associated therewith; (b) printing on a receiver medium a sequence of spaced discrete second dots from a second nozzle bank having plural nozzles associated therewith, the second dots being spaced from the first dots and at least some of the second dots being located at distances closer to at least some of the first dots than the respective nozzle spacings between nozzles on the second nozzle bank which emitted the at least some of the second dots and the nozzles on the first nozzle bank that emitted the at least some of the first dots; (c) determining a placement error for the at least some of the second dots; and (d) adjusting alignment of the second nozzle bank in accordance with any errors determined in placement.

In accordance with a second aspect of the invention, a calibration method of aligning the printing of dots generated by different nozzle banks of an ink jet printer apparatus, the method comprising the steps of (a) printing on a receiver medium a sequence of spaced discrete first dots of a first color from one nozzle bank having plural nozzles associated therewith, the first dots being printed in a predetermined pattern; (b) printing on the receiver medium a sequence of spaced discrete second dots of a second color from a second nozzle bank having plural nozzles associated therewith, at least some of the second dots being printed within the pattern; (c) generating through examination of the receiver medium or a reproduction thereof color information regarding the dots printed on the receiver medium; (d) using the color information to identify locations of the second dots; (e) determining placement errors for the at least some of the second dots; and (f) adjusting alignment of the second nozzle bank in accordance with any errors determined in placement.

In accordance with a third aspect of the invention, a method of aligning the recording of pixels by different recording element banks of a printer apparatus comprising the steps of printing on a recording medium a predetermined pattern of discrete pixels by plural recording elements of each of at least first and second banks, each discrete pixel being printed by a single one of the recording elements; removing the recording medium from the printer apparatus; examining the recording medium or a reproduction thereof at a resolution of at least 500 DPI to derive electronic information relative to the location of pixels in the printed pattern; processing the information to determine respective centers of the pixels; determining errors in location of the determined centers of the pixels from where the centers should be if the banks were properly aligned; determining needed adjustments of a bank or banks or recording elements in the bank or banks to improve alignment of the pixel recording by such bank or banks or recording elements in the bank or banks; and adjusting alignment of pixel recording by at least one bank or at least some of the recording elements therein in accordance with a determination of needed adjustments.

In accordance with a fourth feature of the invention, a calibration method of aligning the printing of dots by different nozzle banks of an ink jet printer apparatus, the method comprising the steps of (a) printing on a receiver medium a sequence of spaced discrete first dots from one nozzle bank having plural nozzles associated therewith, the first dots being printed in a predetermined pattern; (b) printing on the receiver medium a sequence of spaced discrete second dots from a second nozzle bank having plural nozzles associated therewith, at least some of the second dots being printed within the pattern; (c) generating through examination of the receiver medium or a reproduction thereof information regarding the dots printed on the receiver medium; (d) using the information to identify locations of the second dots; (e) determining placement errors for the at least some of the second dots; and (f) adjusting alignment of the second nozzle bank in accordance with any errors determined in placement.

In accordance with a fifth aspect of the invention, a method of aligning drops emitted by an ink jet printer having a nozzle that is capable of emitting drops of liquid of different drop sizes in response to different actuation signals to form different dots sizes on a recording medium, the method comprising providing different timings of initiating activation of the respective signals to an actuator associated with the nozzle so that in generating different drop sizes emitted by that nozzle and to correct for alignment errors in emitting drops of different sizes timing of initiating activation of the actuation signal for generating a drop of one drop size is provided with an adjustment relative to timing of initiating activation of an actuation signal of a second and different drop size.

In accordance with a sixth aspect of the invention, a method of aligning drops emitted by an ink jet printer having a series of nozzles formed on a nozzle bank, the method comprising generating plural discrete dots recorded by plural nozzles from the nozzle bank during multiple passes of the nozzle bank over a receiver medium, wherein at least some of the discrete dots are recorded during different passes and a discrete dot recorded by one nozzle during one pass is spaced on the receiver medium at a closer distance to a second discrete dot recorded by a second nozzle during a second pass than the spacing between the first and second nozzles on the nozzle bank; determining error in placement of at least one of the discrete dots; and correcting error in recording of dots by the nozzle bank.

In accordance with a seventh aspect of the invention, a method for correcting errors in recording by an ink jet printhead having a plurality of nozzles comprising moving the printhead relative to a recording medium and forming discrete dots on the recording medium during each of plural passes of movement of the printhead relative to the recording medium so that a particular nozzle forms a respective discrete dot during a respective pass; analyzing the recording medium to determine locations of dots recorded in accordance with expected locations and in accordance with the respective pass in which the dots were recorded; determining errors in locations of dots relative to expected locations for such dots; and using determined errors to correct the recording of dots by the printhead.

In accordance with a eighth aspect of the invention, a method for correcting errors in recording of dots by an ink jet printhead having plural nozzles, the method comprising generating an image file of discrete dots to be recorded by the printhead, the file being in a standardized graphic display file format; printing the discrete dots on a receiver medium in plural passes of the inkjet printhead; determining errors in placement of dots by respective nozzles; and providing adjustments in alignment of the printhead or in firing times of the nozzles to correct for the errors.

In accordance with a ninth aspect of the invention, a method for correcting errors in recording of dots by an ink jet printhead having plural nozzles, the method comprising forming discrete dots from respective nozzles in each of plural passes on a receiver medium, a spacing of the receiver medium from the printhead during one pass being different from a spacing of the receiver medium from the printhead during a second pass determining errors in placement of dots by respective nozzles for the one pass and the second pass; and providing adjustments in alignment of the printhead or in firing times of the nozzles to correct for the errors.

In accordance with a tenth aspect of the invention a method for correcting errors in recording of dots by an ink jet printhead having plural nozzles, the method comprising forming discrete dots from respective nozzles in each of plural passes on a receiver medium, a speed of the printhead relative to the receiver medium during one pass being different from a speed of the printhead relative to the receiver medium during a second pass; determining errors in placement of dots by respective nozzles for the one pass and the second pass; and providing adjustments in alignment of the printhead or in firing times of the nozzles to correct for the errors.

In accordance with a first embodiment of the invention, the printer being adjusted is (a) commanded to print a set of dots by all or possibly a subset of the nozzles within a nozzle bank. The target contains dots printed by combination of a minimum of two of the nozzle banks but ideally by a combination of all the nozzle banks. Each dot is printed sufficiently distant from its neighboring dots such that each dot is separate and distinct. The target is then (b) removed from the printer by an operator and located in an instrument designed to digitize the sample and (c) the sample is digitized. The means by which the target may be digitized are widely varying, but typically a flat-bed scanner, a drum scanner, or a digital camera are most useful and sufficient for the purpose. The digitized image is then (d) sent through an image-processing algorithm that detects each separate dot, locating each dots center in Cartesian coordinates. The ideal locations of each dot are then (e) calculated by using the absolute locations of the dots printed by a reference nozzle bank. Errors in placement, calculated by the difference between the actual location and the ideal location, are (f) tallied for each nozzle. Knowledge of the nozzle bank and carriage geometry (e.g., center-of-rotation of each nozzle bank) can then (g) be used in combination with each dot's error to determine what adjustments should be made to the alignment of each nozzle bank. Calculations in this manner can be used to deconvolve all alignment adjustments (if angular adjustments result in fast-scan or slow-scan displacements, for example, due to the center of rotation being displaced from the center of the nozzle bank) and no iteration is required.

In accordance with a second feature of the invention, the target remains on the printer and an imaging sensor capable of creating a 2-d bitmap of the target is used to digitize the sample.

In accordance with a third feature of the invention, the ideal locations are determined by the use of fiducials printed by a reference nozzle bank located at the extremes of the target or possibly internal to the target.

In accordance with a fourth feature of the invention, the ideal locations are determined by observing the relative locations of dots printed by a small set of nozzles from a single nozzle bank.

In accordance with a fifth feature of the invention, the target is ideally printed by several passes of the print heads with a media advance in between one or all of the passes. This allows for dots printed by one end of a nozzle bank to be in close proximity to dots printed by the other extreme of the nozzle bank regardless of the overall length of the nozzle bank. Proper design of the target in this manner ensures accurate measurement of nozzle bank skew while keeping the target relatively small in size, thereby decreasing the required receiver to perform the test and the amount of imagery that must be scanned, decreasing overall measurement time.

In accordance with a sixth feature of the invention, all alignment adjustment parameters are electronically downloaded to the printer which then makes the appropriate adjustments, perhaps by adjusting the firing timing of each nozzle or by mechanically moving the nozzle banks with the aid of a mechanical device.

While the specification concludes with claims particularly pointing out and distinctly claiming the subject matter of the present invention, it is believed the invention will be better understood from the following detailed description when taken in conjunction with the accompanying drawings wherein:

BRIEF DESCRIPTION OF THE DRAWINGS

FIG. 15 is a Dot-to-Nozzle Map as described herein.

DETAILED DESCRIPTION OF THE INVENTION

Figure 1:
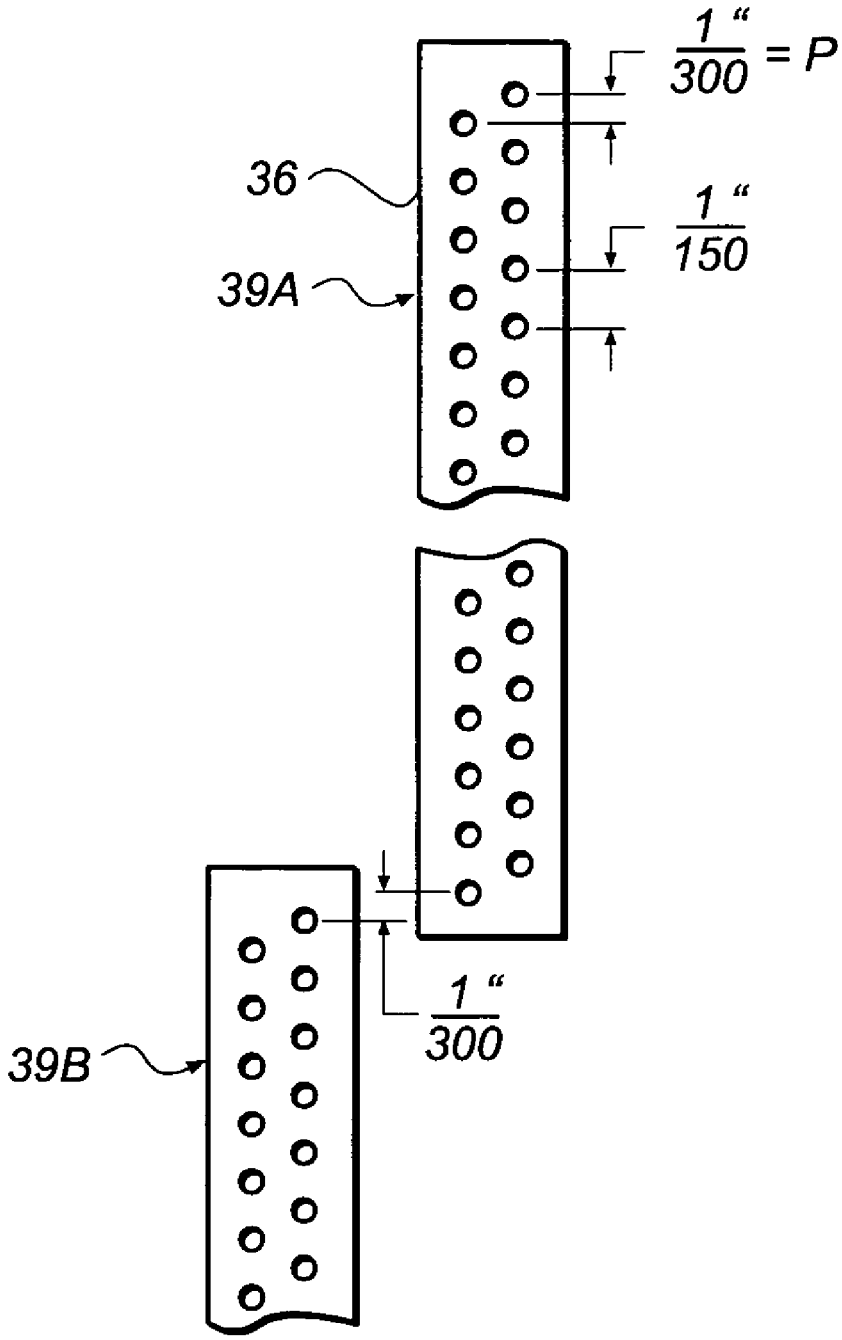
FIG. 1 (PRIOR ART)
FIG. 1 illustrates a prior art printhead featuring two printhead nozzle banks.
Figure 2:
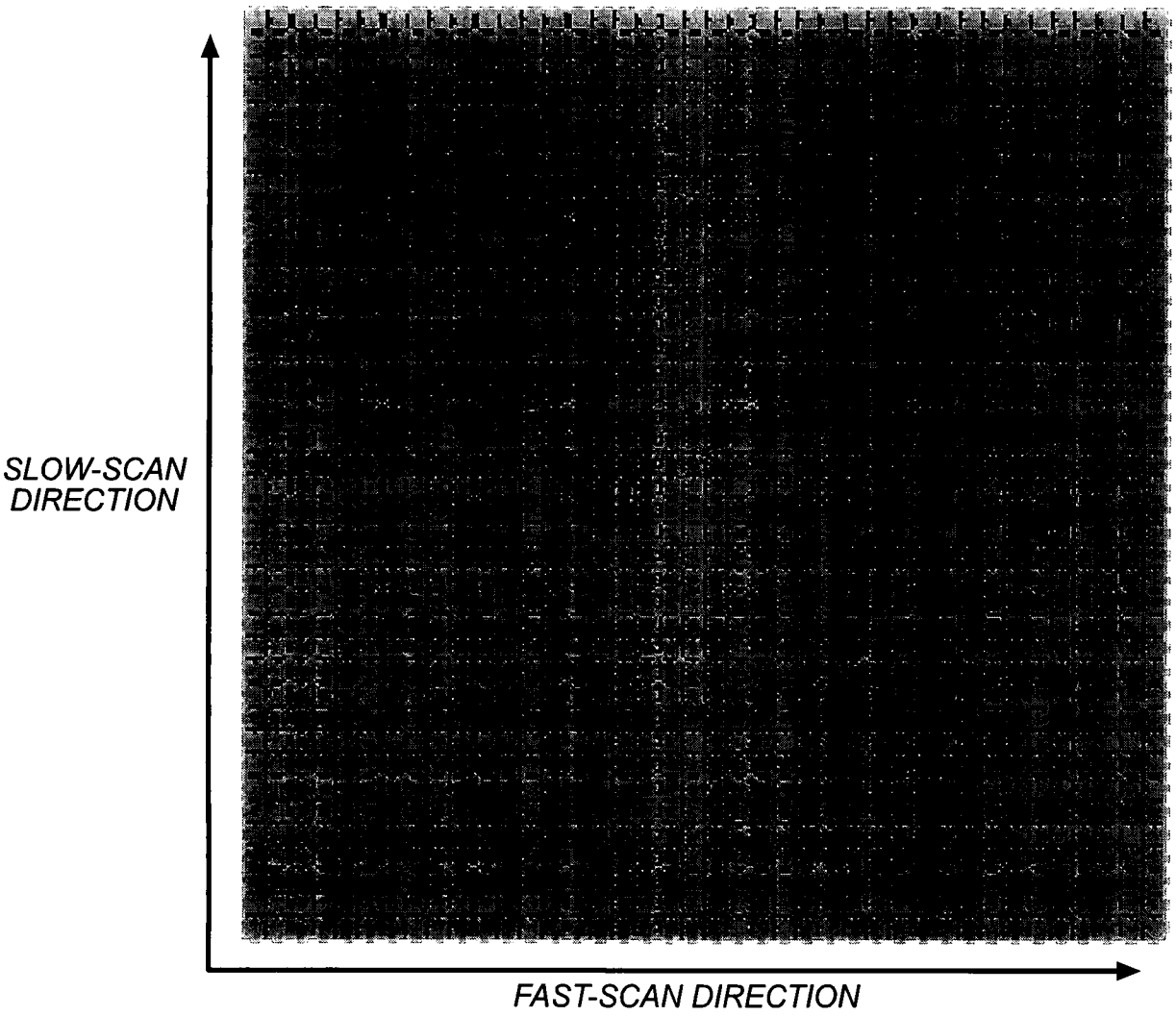
FIG. 2 illustrates an enlargement of a ~1/7.5"×1/7.5" simulated flat-field image printed by a nozzle configuration as shown in FIG. 1 wherein there is good alignment between all of the nozzle banks. The simulation in this case considers a 300 dpi image with round dots each having a diameter of 115 microns printed using two passes. Gray indicates a printed dot and black indicates overlap of dots in this flat field.
Figure 3:
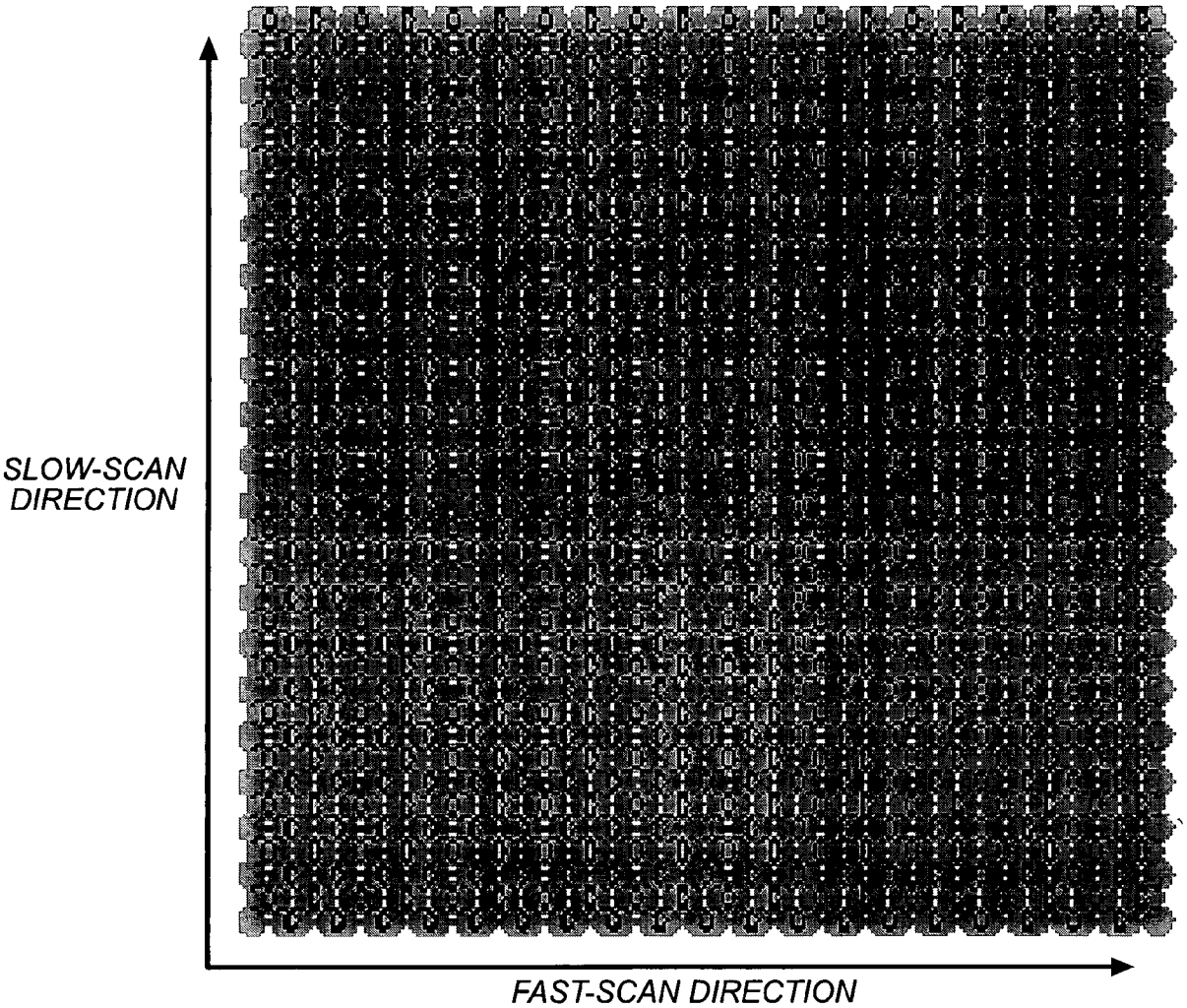
FIG. 3 illustrates an enlargement of a ~1/7.5"×1/7.5" simulated flat field image printed by a nozzle configuration as shown in FIG. 1 wherein there is a misalignment of 35 microns in the fast-scan direction. The simulation also considers a 300 dpi image with round dots each having a diameter of 115 microns printed using two passes. The white spaces visible between dots imply misalignment in the fast scan direction.
Figure 4:
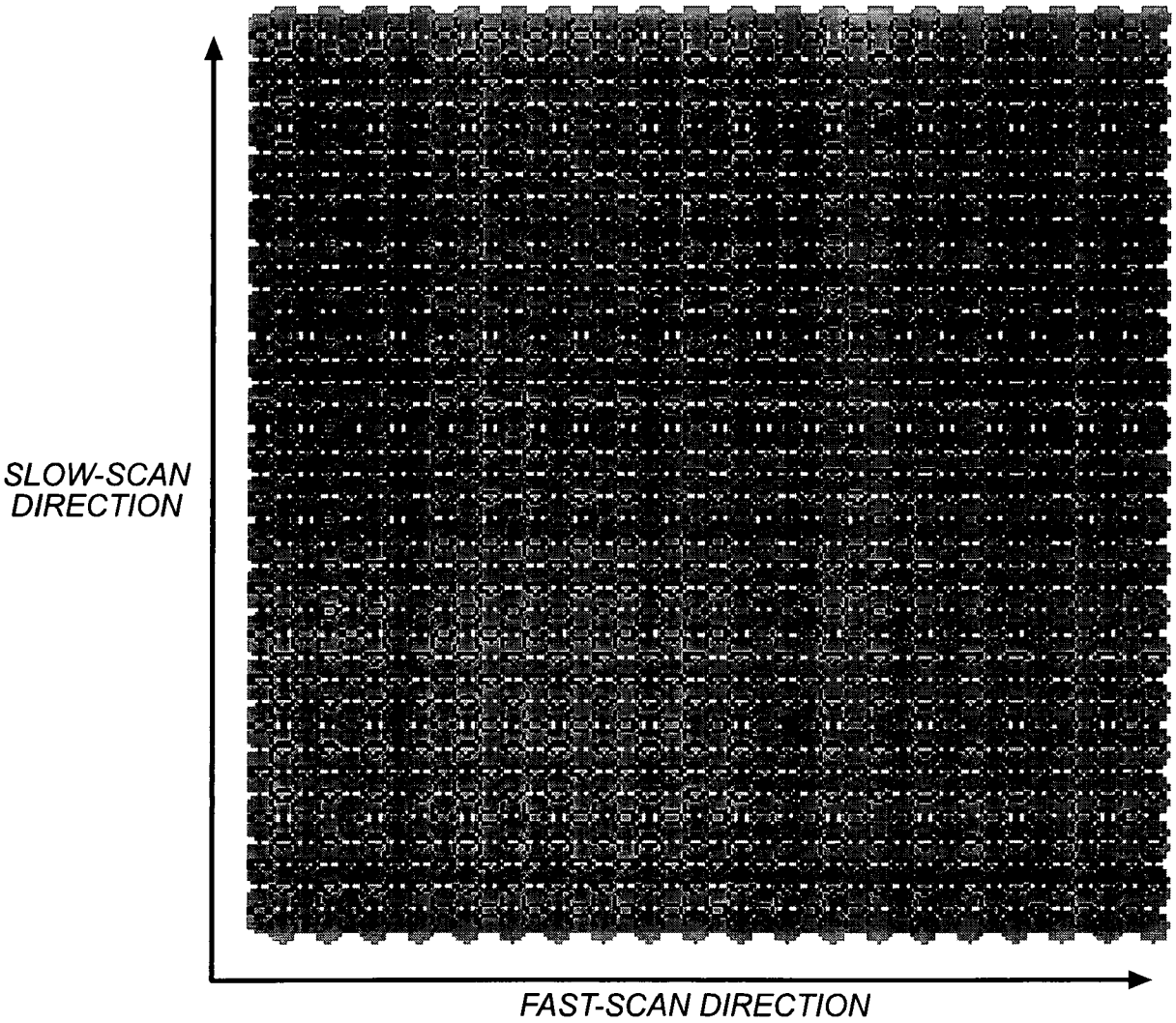
FIG. 4 illustrates an enlargement of a ~1/7.5"×1/7.5" simulated flat field image printed by a nozzle configuration as shown in FIG. 1 wherein there is a misalignment of 35 microns in the slow-scan direction. The simulation also considers a 300 dpi image with round dots each having a diameter of 115 microns printed using two passes. The white dots imply misalignment in the slow scan direction.
Figure 5:
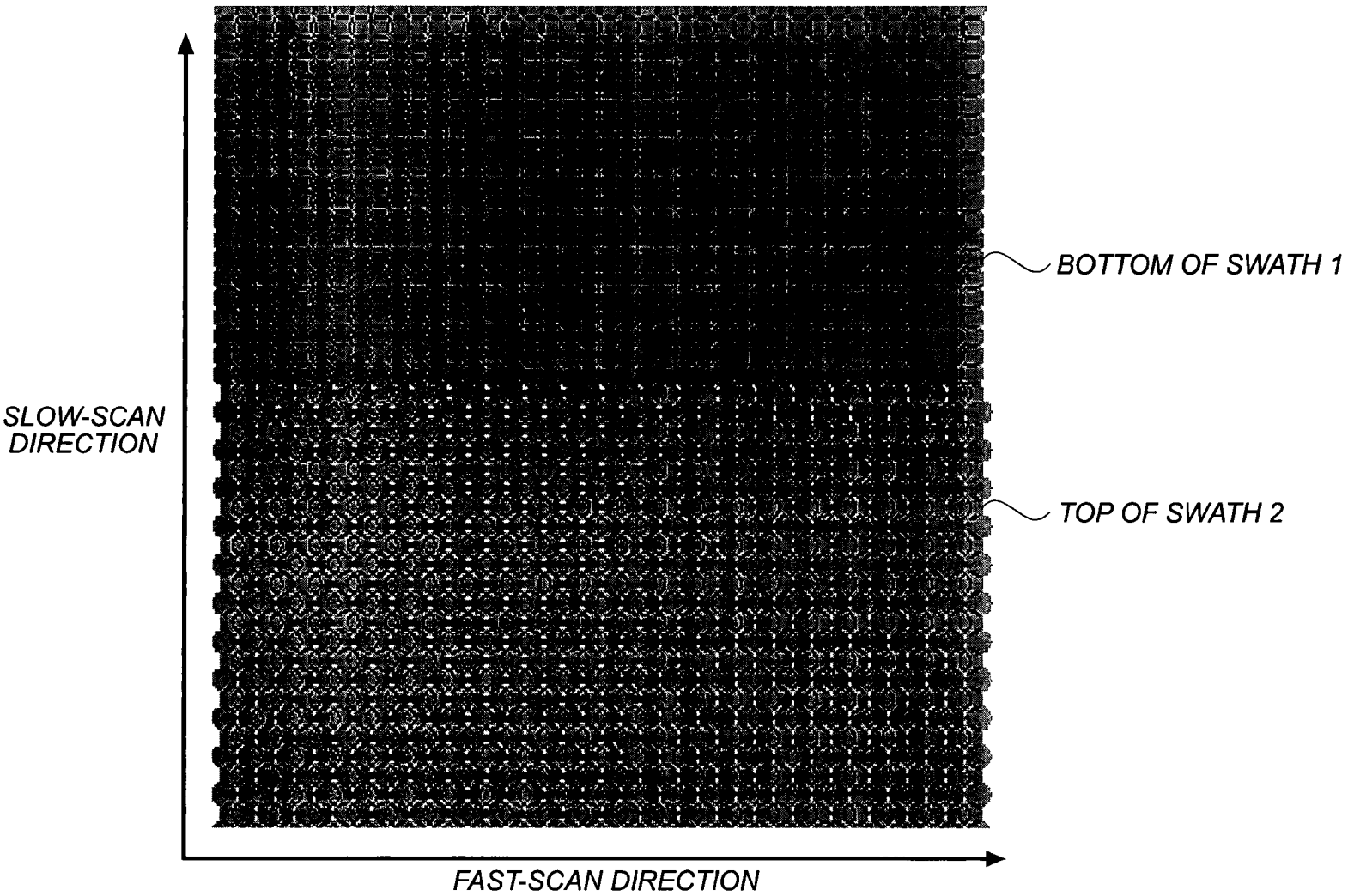
FIG. 5 illustrates an enlargement of a portion a ~1/7.5"×1/7.5" simulated flat field image printed by a nozzle configuration as shown in FIG. 1 wherein there is an angular misalignment of 0.08 degrees between the two nozzle banks. The portion of the image shown is centered at approximately one-inch below the top of the image such that the top of the enlargement shows the bottom of the first swath and the bottom of the image shows the top of the second swath. The simulation also considers a 300 dpi image with round dots each having a diameter of 115 microns printed using two passes. The angular misalignment creates the visible banding.

The present description will be directed in particular to elements forming part of, or cooperating more directly with, apparatus and methods in accordance with the present invention. It is to be understood that elements not specifically shown or described may take various forms well known to those skilled in the art.

In the specification, various terms are employed and are defined as follows:

The term "banding" refers to an imaging artifact in which objectionable lines or density variations are visible up and in the image. Banding may occur as vertical banding or horizontal banding, the horizontal direction coinciding with the fast scan direction and the vertical direction coinciding with the slow scan direction.

The term "dot size" relates to the size of a printed dot and may be determined by thresholding a digitized target containing the dots, the dot size may be expressed as an area, diameter, or other convenient metric. Dot size may be inferred from optical density of the centers of printed dots.

The term "drop size" may be expressed in units of volume or diameter and relates to the size of the drop ejected by a nozzle.

The terms "alignment" and "registration" are used interchangeably and refer to the degree of accuracy to which dots printed by one nozzle bank can be placed relative to the dots placed by other nozzle banks. Alignment and registration include relative dot displacements in the slow-scan and fast-scan and/or combinations of those displacements due to variable nozzle bank rotation in the X-Y plane as defined by FIG. 10.

The term "flat field image" refers to an image in which the code value is relatively constant. In the examples provided herein, the flat field image means that a drop is requested at every pixel location in a relatively small area sufficient to provide enough data for the purposes described herein. It will be understood of course that in performing the method of the invention there is consideration of hypothetical printing of flat field images which are done as computer simulation and not as actual printings.

The term "human contrast sensitivity function" refers to a description of the acutance of the human vision system as a function of cycle/degree and may be inferred from various known functions that have been determined to meet the criteria or by an approximation thereof, for example, such as a Gaussian distribution.

The term "raster row" refers to a horizontal swath of an image of height equal to 1/DPI.

The term "DPI" means dots-per-inch. In the case of symmetric printing, the DPI is the same in both the fast scan and slow-scan directions. For asymmetric printing, DPI refers to the resolution in the slow scan direction.

The term "fast-scan direction" refers to the direction in which the printhead is transported during a print pass.

The term "slow-scan direction" refers to the direction in which the receiver medium is advanced in between print passes. Typically, the fast scan direction and the slow scan direction are orthogonal.

The phrase "to digitize a printed target," means to convert a physical target containing dots printed by a printer into digital image information containing a meaningful representation of that target which may be subsequently processed by various algorithms.

The term "Dot-to-Nozzle Mapping" refers to a description for each printed dot that describes the nozzle bank that printed or is to print that dot, the nozzle number that printed or is to print that dot, and the pass on which that dot was or is to be printed by said nozzle.

The term "thresholding" refers to defining a code value below which is considered part of a dot and above which is considered not to be part of a dot within a digitized target. Higher code values in the digitized target are assumed to be associated with lower optical density in the physical target.

The term "satellite" refers to a small, usually unintentional drop that accompanies a larger, "parent" drop that falls onto the receiver at a location separated from the dot due to the parent drop.

The term "centroid" or "dot centroid" refers to the physical center of a dot. That center may be determined by simple center-of-mass calculations or similar methodologies. More advanced methods may weight each pixel location by its code value before determining the center-of-mass.

The term "receiver" is used interchangeably with "recording medium".

Multiple print passes over a swath may be used for reasons of requiring isolation of ink drops both spatially and temporally by employing a print mask which specifies in which locations a drop is ejected from the printhead on each of plural passes in printing of a swath. In addition, multiple print passes may be provided for increasing the resolution of the print to provide smaller desired dot pitches. For example, a printhead having a nominal 1/300 inches pitch resolution may be used to print at 600 DPI by providing two resolution passes over the swath area or for printing at 1200 DPI by providing four resolution passes over the swath area.

Figure 10:
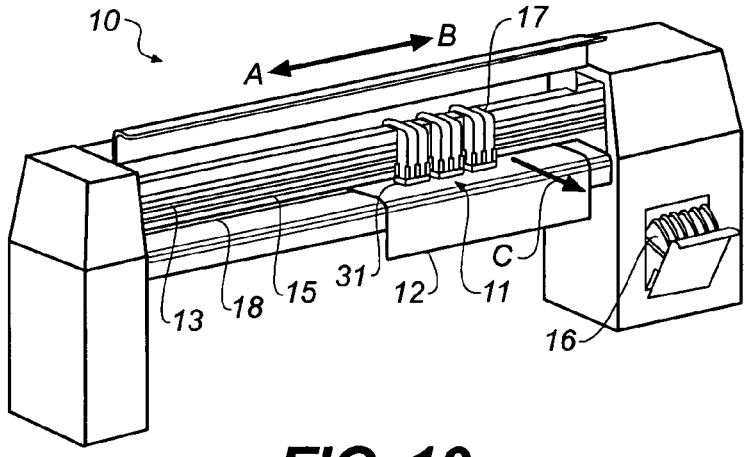
FIG. 10 is a printer which incorporates assembled printhead nozzle banks aligned in accordance with the method described herein.

With reference to FIG. 10, there shown a printer 10 which incorporates printhead nozzle banks aligned in accordance with the methods described above. Reference 11 designates a carriage. An inkjet printhead 31 faces the recording medium and includes nozzle banks 39A and 39B mounted on a printhead modular structure 25 (FIG. 11), which in turn is mounted on the carriage 11. Carriage 11 is coupled through a timing belt 13 with a driver motor (not shown) so as to be reproducibly movable relative to the recording medium 12 (in the directions of the arrows A–B) while being guided by a guide member or rail 15. The inkjet printhead 31 receives ink from a respective ink color bulk supply tank 16 through ink supply tube 17. As is known, a separate smaller supply of ink may be associated with a smaller reservoir closer to the printhead so that the printhead receives ink from the smaller reservoir, which in turn is replenished by the supply tank 16. A different supply of ink is provided to each printhead 31. A transport roller 18, when driven by the drive motor (not shown), transports the recording medium 12 in the direction (arrow C) perpendicular to the moving direction of the carriage 11.

Figure 11:
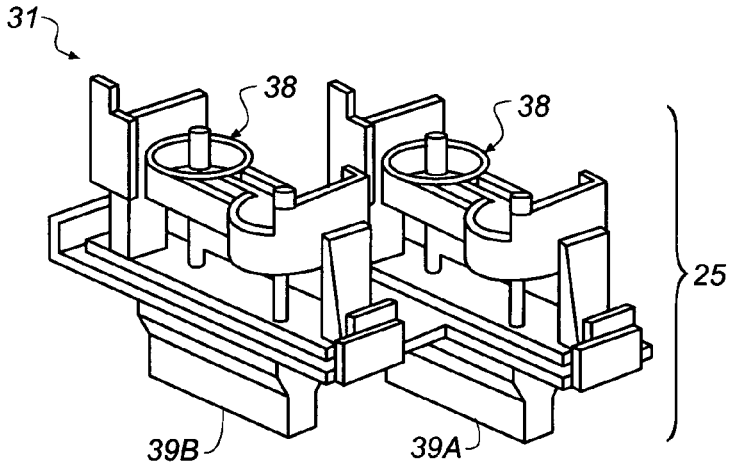
FIG. 11 illustrates a printhead assembly module featuring two nozzle banks for use in the printer of FIG. 10.
Figure 12:
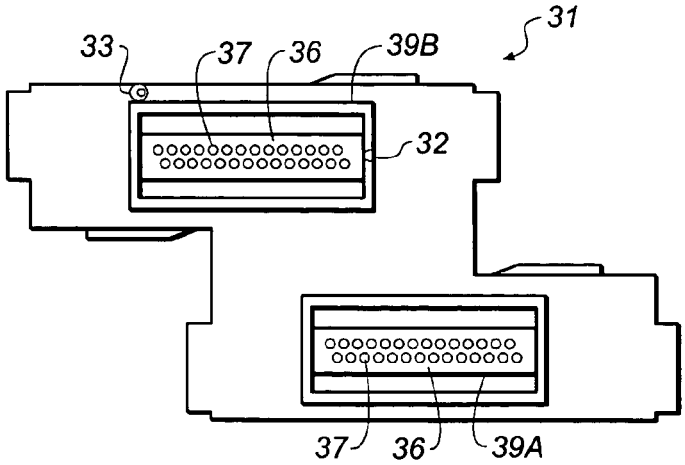
FIG. 12 illustrates the printhead assembly module of FIG. 11 and viewed from the prospective of a receiver medium.

FIGS. 11 and 12 show an embodiment of a piezoelectric printhead assembly module 25 that features the two assembled nozzle banks 39A and 39B. Reference No. 36 designates a nozzle plate, associated with each nozzle bank, and having nozzle openings 37 formed therein. A supply port 38 is provided on assembly module 25 through which ink flows from the ink tank 16 (or from a separate reservoir as noted above) via an ink supply tube 17. Although illustration is provided of a piezoelectric printhead the invention may be carried out with other printheads such as thermal and continuous inkjet printheads.

Six different color printheads are arranged on the carriage 11 and as the carriage is traversed across the receiver sheet 12 for a print pass the nozzles in each of the six color printheads are actuated to print with ink in their respective colors in accordance with the image instructions received from the controller or image processor such as a RIP (raster image processor) and as such instructions are modified in accordance with the teachings described in U.S. Pat. No. 6,464,330 as a preferred example. Typically, in printers of this type the number of nozzles provided is insufficient to print an entire image during a print pass and thus plural print passes are required to print an image with the receiver sheet being indexed in the direction of the arrow C (FIG. 10) after each pass. Where print masking is used, typically indexing of the receiver sheet in the slow scan direction is done for an amount less than the length of the nozzle bank until the image that is to be printed in this swath is printed through multiple passes of the printhead.

Thus, the inkjet printer configurations employed herein comprise one or more inkjet printheads each of which have two or more banks of nozzles. Each nozzle can eject drops independently. An inkjet printhead drive mechanism moves the printhead in a direction transverse or generally perpendicular to the array of nozzles. This direction is referred to as the fast scan direction. Mechanisms for moving the printhead in this direction are well known and usually comprise providing the support of the printhead (or a carriage supporting the printhead) on rails, which may include a rail that has a screw thread, and advancing the printhead along the rails such as by rotating the rail with the screw thread or otherwise advancing the printhead along the rails such as by using a timing belt and carriage. Such mechanisms typically provide a back and forth movement to the printhead. Signals to the printhead, including data and control signals, can be delivered through a flexible band of wires or an electro-optical link. As the printhead is transported in the fast scan direction, the nozzles selectively eject drops at intervals in accordance with enabling signals from the controller that is responsive to image data input into the printer and position of the carriage (pass position) and identification of the pass number. The intervals in combination with the nozzles spacing represent an addressable rectilinear grid, or raster, on which drops are placed. A pass of the printhead during which drops are ejected is known as a print pass. The drops ejected during a print pass land on an inkjet receiver medium. After one or more print passes, the print media drive moves the inkjet print receiver medium; i.e., the receiver sheet such as paper, coated paper or plastic or a plate from which prints can be made (lithographic plate), past the printhead in a slow scan direction which is perpendicular to or transverse to the fast scan direction. After the print medium or receiver media member has been advanced, the printhead executes another set of one or more print passes. Printing during the next pass may be while the printhead is moving in the reverse direction to that moved during the prior pass. The receiver member may be a discrete sheet driven by a roller or other known driving device or the receiver sheet may be a continuous sheet driven, typically intermittently, by a drive to a take-up roller or to a feed roller drive.

Figure 13:
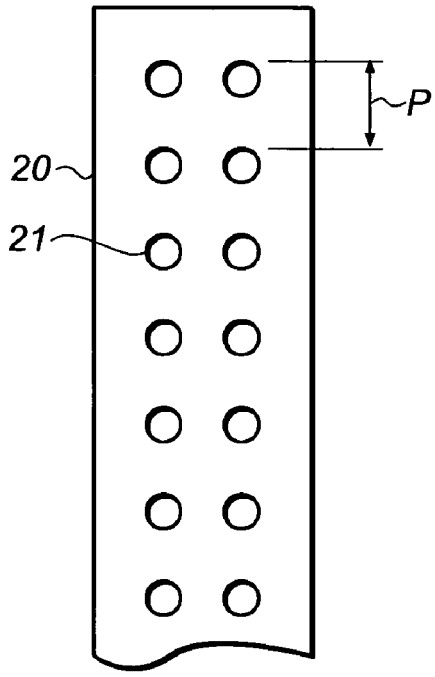
FIG. 13 illustrates an alternative nozzle bank configuration with which the invention may be used.

Printheads to which this invention is directed may also comprise nozzle banks 20 shown in FIG. 13 wherein one or two parallel rows of nozzles 21 that are not staggered thus allowing printing of at least certain pixels using drops output by two nozzles in succession at the same pixel location.

Figure 14:
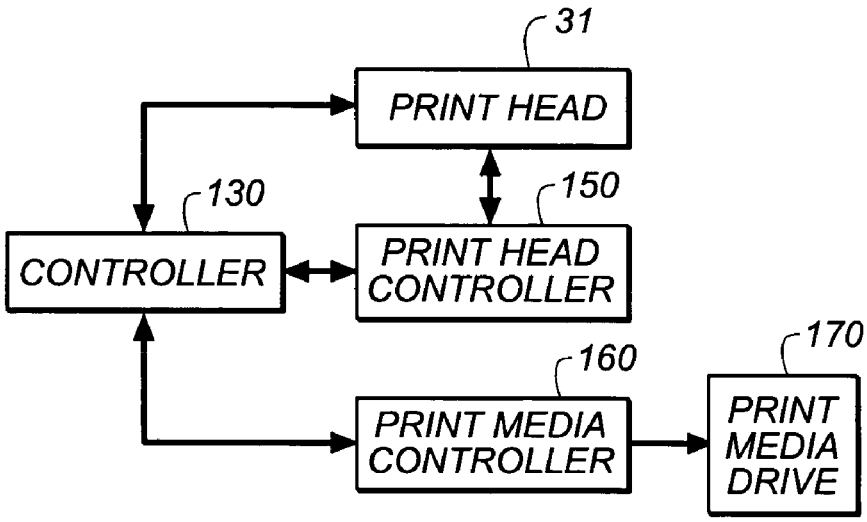
FIG. 14 is a block diagram of a printer control system.

Referring now to FIG. 14, an inkjet printer is schematically shown in which a controller 130 controls a printhead 31, a printhead controller and driver 150 and a print media controller and driver 160. The controller 130, which may include one more micro-computers is suitably programmed to provide signals to the printhead controller and driver 150 that directs the printhead drive to move the printhead in the fast-scan direction. While the printhead is moving in the fast-scan direction, the controller directs the printhead to eject ink drops onto the receiver medium at appropriate pixel locations of a raster when pixels on the raster are being selectively printed in accordance with image signals representing print or no print decisions in each pixel location and/or pixel density gradient or drop size at each pixel location. The controller 130 may include a raster image processor, which controls image manipulation of an image file, which may be delivered to the printer via a remotely located computer through a communication port. On board memory stores the image file while the printer is in operation. Thus, as noted above, the printer may include a number of printheads for printing a respective number of color inks, and preferably the printer includes enough printheads to print three or more different color inks.

In accordance with the invention and as taught herein, reduction in banding, increased optical density, increased sharpness, and improved image fidelity may be achieved with less operator invention and less consumption of ink and recording medium through proper and efficient alignment of printhead nozzle banks for use in a printer containing multiple nozzle banks.

Figure 6:
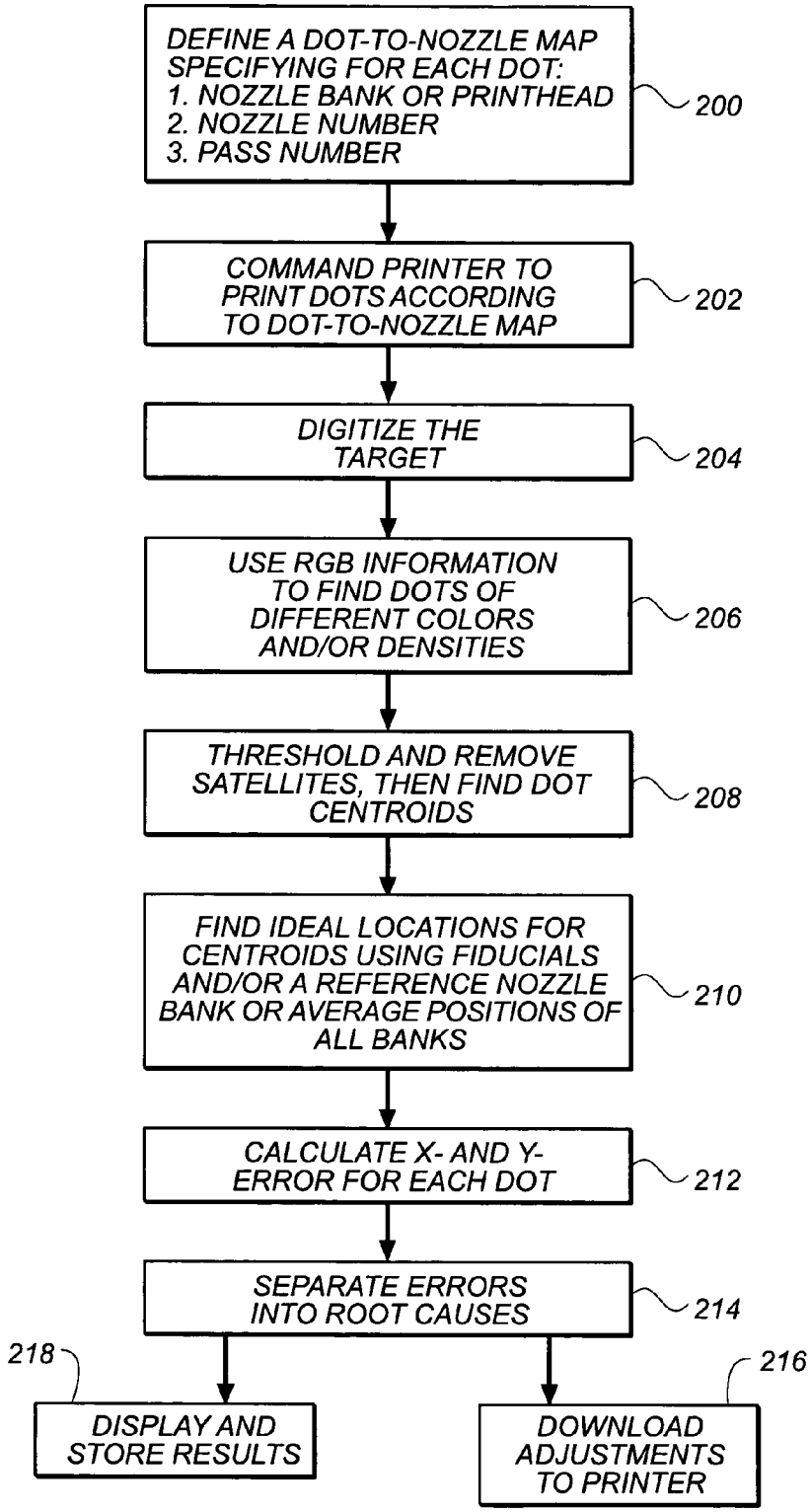
FIG. 6 is a flowchart illustrating steps in a method of aligning nozzle banks in accordance with this invention.
Figure 8:
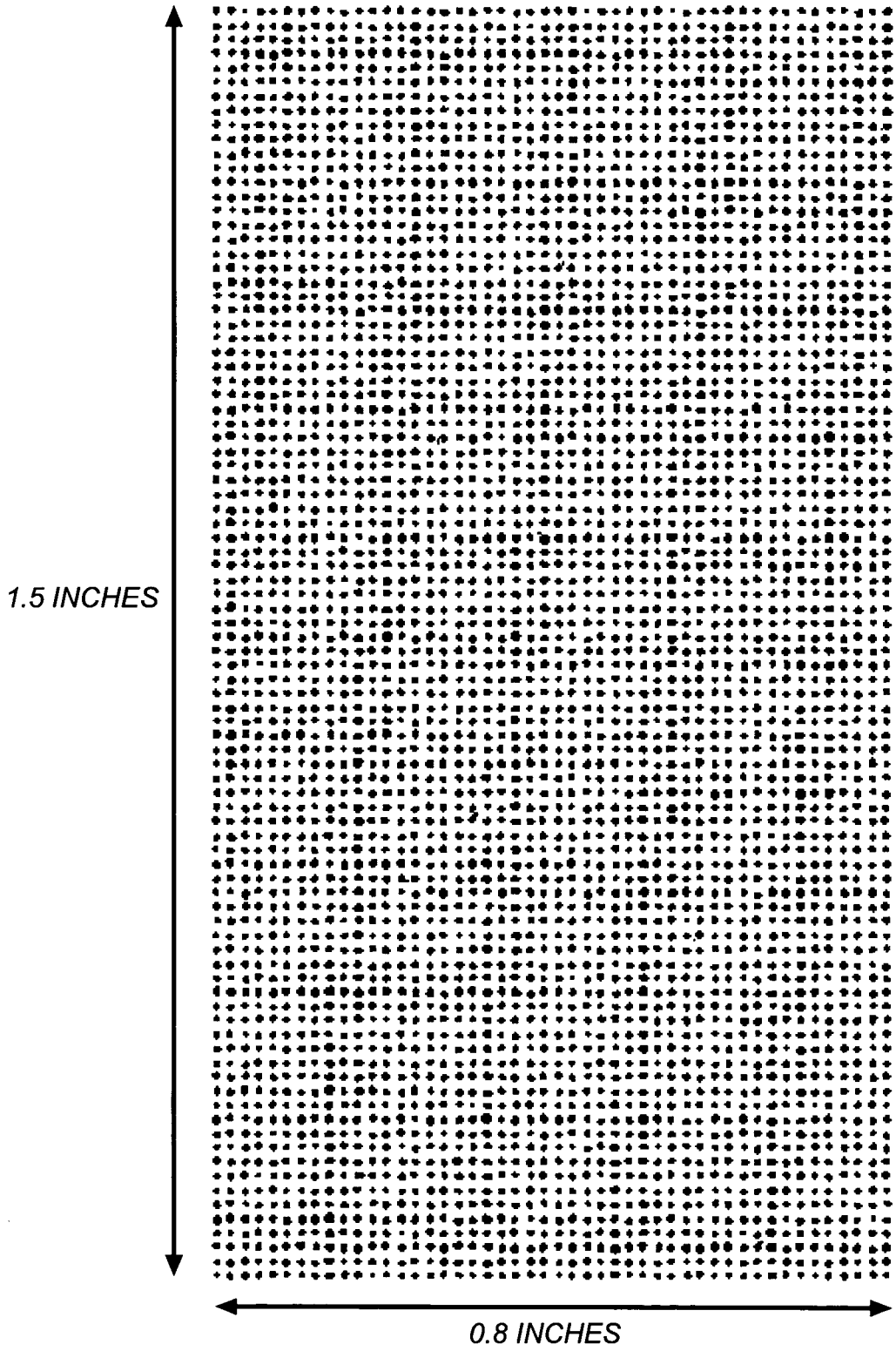
FIG. 8 is a scan of a target that could be used to align a six channel printer (Cyan, Magenta, Light Cyan, Light Magenta, Yellow, and Black) in accordance with this invention. The illustrated dots can be of different colors or black.
Figure 9:
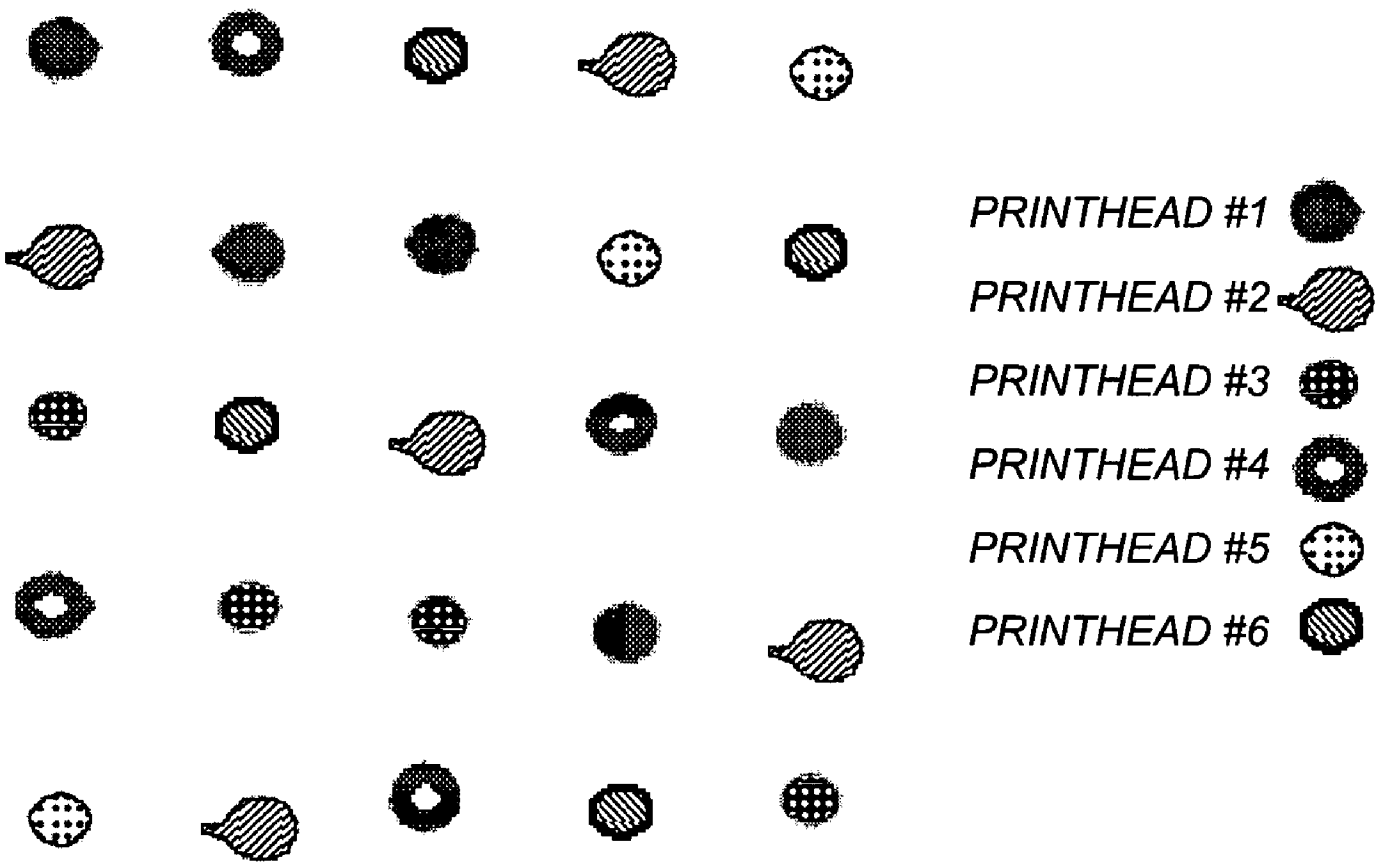
FIG. 9 is an enlargement of the top-left corner of FIG. 8.

The basic concept of this invention may be best understood by examining the steps of the alignment process outlined in FIG. 6. In Step 200 of FIG. 6, a pattern is defined that specifies a spatial distribution of dots. For each dot within this distribution, the nozzle responsible for printing that dot is specified as well as the pass on which the dot is to be printed. This complete specification will be referred to as the "Dot-to-Nozzle Map". A portion of one such example mapping is provided in FIG. 15. This example Dot-to-Nozzle Map shows a 25×25 raster in which every fifth pixel is to be populated by a dot. Each blank pixel in FIG. 15 indicates no dot is requested at this pixel location on the raster. For each requested dot in the Dot-to-Nozzle Map, note that the printhead and the specific nozzle responsible for ejecting the drop along with the pass on which the dot was printed are all specified in the format [xn,yn,zn] where xn is the printhead identifier, yn is the nozzle number within that printhead, and zn is the pass number. In this example, a simple arrangement is considered in which a printer has six colors (cyan, magenta, yellow, black, light cyan, and light magenta, numbered sequentially from one to six) and a single printhead for each color, each printhead containing 600 nozzles numbered sequentially from 1 to 600. Each printhead may be comprised of two nozzle banks with nozzles 1–300 on one bank and nozzles 301–600 on the other bank as shown in FIG. 1 or alternatively it may be a printhead comprised of a single nozzle bank of 600 nozzles. FIG. 9 shows how this small Dot-to-Nozzle Map might print on such a printer. As FIG. 8 might indicate, a typical Dot-to-Nozzle Map might be significantly larger than the example depicted in FIG. 15.

There are several important considerations in designing the Dot-to-Nozzle Map. First, most digitization equipment can produce relatively accurate and reliable distance measurements over small distances. Flat-bed scanners, for instance, must convey the sample past a linear sensor array. Errors in the conveyance can accumulate and make measurements over several inches very suspect. Likewise, optics in digital cameras suffer slight aberrations which can cause similar issues from one end of the 2-d sensor array to the other. Therefore, the most credible distance measurements are made over relatively short distances. Therefore, the Dot-to-Nozzle Map should ideally command the printer to place dots from different parts of a nozzle bank in relatively close proximity to each other. This makes the measurement of angular displacements much more trustworthy since the relative displacement of two dots printed by two different nozzles of the same nozzle bank will be proportional to the distance between the nozzles. The dot printed at raster-row #1, raster-column #1, for instance is a cyan dot printed by nozzle # 147. See FIG. 1 for nozzle numbering for the configuration of nozzle banks as in FIG. 1. The dot at raster-row #6, raster-column #6 is also cyan but is printed by nozzle #600 (last nozzle on nozzle banks 39B) which is on a different nozzle bank than that of nozzle #147. The relative error in the placement of these two dots will give a very good indication of the angular displacement of the cyan nozzle bank.

Another consideration for the Dot-to-Nozzle Map is the relative placement of dots printed by different nozzle banks. By placing dots from the different nozzle banks in close proximity to each other, relative displacements are very easy to measure with commonly available digitization techniques. Considering FIG. 9, one can see that the dots printed by printhead #2 (magenta) are displaced slightly in the slow-scan direction relative to the other printheads. This displacement would be readily detected by many digitization techniques. Thus, in placing dots for this calibration some dots are deposited on the receiver that are spaced from one another at closer spacings than the spacings between the respective nozzles that deposited those dots.

Another consideration for the Dot-to-Nozzle Map is the relative placement of dots printed by different passes of the printer carriage. By causing the receiver to advance between each pass, an estimate of the error due to each advance may be calculated. Accurate advancement of the receiver is a critical component to accurately place dots onto the receiver and therefore directly impacts final quality of the printed image. By proper processing of all the relative errors, the error in receiver advance can easily be decoupled from the errors in alignment of the nozzle banks. Careful analysis of the receiver advance can lead to improved adjustment of the advance and an assessment of the variation in advance, the latter possibly suggesting printer service may be needed.

Another consideration for the Dot-to-Nozzle Map is the replication afforded by an intelligent design of the pattern. Note that the very small example Dot-to-Nozzle Map of FIG. 15 contains nearly all of the features described above but yet consumes only about 0.005 square inches space. By repeating this pattern or, more ideally, patterns similar to it but exercising different nozzles where possible, an incredible amount of averaging is possible within a very small amount of space. FIG. 8, for example, consumes only 1.2 square inches, but it has approximately 250 repetitions of Dot-to-Nozzle Maps similar to FIG. 15. This high degree of averaging in such a relatively small area permits the use of relatively inexpensive and abundantly available digitization equipment such as flat bed scanners. Furthermore, this high degree of averaging improves the confidence in the measurements, permitting highly accurate alignment adjustments. Lastly, inkjet printheads are known to have some limitations in the accuracy by which they can eject droplets. By exercising many different nozzles of a nozzle bank, any dot placement errors intrinsic to the nozzle bank can be removed by this extensive averaging.

Printers capable of ejecting different sized drops, often referred to as "multitoning" represent another design consideration for the Dot-to-Nozzle Map. As described above, the difference in drag during flight causes the drop velocity of smaller drops to be different than that of larger drops. This can lead to the final alignment being sub-optimal for some drop sizes. By designing the Dot-to-Nozzle Map such that different sized drops are ejected by the various nozzle banks, these small differences can be accounted for by making minor adjustments to the nozzle enabling waveforms that are used to eject the drops (thus adjustments may comprise varying the time of ejection for different drop sizes) or by using different alignment settings based upon the requested print mode that may only use a subset of all available drop sizes.

In step 202 of FIG. 6, the printer is commanded to print the Dot-to-Nozzle Map. This is done by inputting image data into the controller 130 in accordance with the predetermined Dot-to-Nozzle map. Alternatively, the program providing such image data is stored in the controller 130.

In step 204 of FIG. 6, the printed image resulting from step 202, also called "the target", is turned into digital form. There are a myriad of techniques by which this may be accomplished. The simplest and most straightforward of these techniques is to use a flatbed scanner to scan the receiver medium that has been printed with the calibration pattern. In using a flatbed scanner, the target is typically removed from the printer and placed onto the scanner platen. The scanner features one or more rows of sensor elements which rows extend for a full width of the calibration pattern. The scanning is preferably done at high resolution by moving the target relative to the scanner elements. The extensive averaging described above does not necessitate scanner resolutions greater than two or three times the diameter of the smallest printed dot. For example, if the smallest printed dot is 100 microns in diameter, a scanning resolution of about 500 dots-per-inch is minimally acceptable but 1200 dots-per-inch or more would be preferred. The image may be scanned in single channel, 8-bit mode. However, some ink colors or densities (such as yellow) will be difficult to detect if scanned in single-channel, 8-bit mode and it is therefore desirable to scan in three-channel, 24-bit mode to take advantage of the color filtering capabilities in most color flatbed scanners (step 206) and determine color (RGB information of the respective dot) and density.

Another digitization technique for step 204 is to use a digital camera to digitize the target. In this process, a digital camera is equipped with necessary optics to image the entire target, and a digital picture is taken of the sample. The optics and camera should be of sufficient design and resolution so as to result in a dot covering a minimum of two pixels of the capture device in each direction, similar to the constraints of a flatbed scanner with higher resolution being desirable if possible.

Other digitization techniques will be apparent to those skilled in the art. For example, a drum scanner may be used in place of the flatbed scanner. Likewise, a silver halide picture may be taken of the target and later scanned on a flatbed or drum scanner for digitization. Thin slit apertures in combination with photosensors are also commonly used to digitize targets. Microdensitometers are yet another option. The invention described herein is not restricted by the digitization technique aside from the ability to obtain the minimum resolution of two pixels in each direction of the digitized target for the smallest dot for which alignment statistics are desired.

In step 208 of FIG. 6, the digitized image is then processed to detect the locations of the dots. This typically consists of several steps. First, a code value of the digitized image is specified to represent the minimum optical density that represents a printed dot. Typically, code values output from flatbed scanners or digital cameras increase as the optical density decreases. Therefore, this threshold code value specifies the code values above which the digitized image is assumed to contain non-printed receiver; below this threshold code value, the digitized image is assumed to represent printed receiver, i.e., a portion of a dot.

There are several means by which the threshold code value may be determined. For instance, others (see IS&T reference) have developed algorithms that examine the entire target, develop a histogram of the code values, and automatically set the threshold. This technique can be very valuable if different types of receivers or inks are routinely tested. Otherwise, the threshold may be determined empirically by trial-and-error. This trial-and-error method is preferred if a single combination of receiver and inks are routinely tested.

After thresholding, the scanned image is now processed to determine which pixels belong to the different dots. This process is well documented in the literature and is commonly referred to as "clustering" or "connected component labeling". See, for example, M. B. Dillencourt, H. Samet, and M. Tamminen, "A General Approach to Connected-Component Labeling for Arbitrary Image Representations," J. ACM, vol. 39, pp. 253–280, 1992.

Following this clustering operation, the area of each dot may be easily determined. As third operation of step 208, dots having an area significantly different than expected can be rejected to facilitate further analysis. Inkjet printers create dots by ejecting droplets. Often times, these main droplets are accompanied by smaller, unintentional droplets called satellites which may land onto the receiver at a location different than the main or parent drop. Typically, when aligning nozzle banks of a printer, these satellites are to be ignored. By removing dots having an area smaller than expected, these satellites may be efficiently removed.

The last process of step 208 is to determine the center of each dot. As shown in FIG. 9, a single dot may occupy many pixels of the digitized target. Intelligent algorithms can determine the center of the dot to an accuracy greater than that of the resolution of the digitized target. Typical techniques include finding the center-of-mass of the region defined by the dot. More advanced techniques will weight each pixel by the code value of the original image, making the determination of the dot centroid even more accurate.

Upon completion of step 208, the actual relative locations of all dot centers are known. To compute the position error of each dot, the ideal location for all dots must be determined, step 210. There are many ways in which this might be accomplished, and an effective and efficient determination of ideal locations may use a combination of these techniques. First, it must be realized that for most alignment settings, the important feature is the dot placement in relation to a given nozzle bank, called the reference nozzle bank. In other words, typically the absolute placement of the dots from a nozzle bank relative to the printer chassis is of much less importance than the placement relative to the other nozzle banks. Therefore, arbitrarily setting one of the nozzle banks as a reference gives a means by which other errors may be determined and nozzle banks subsequently adjusted. The one exception to this is angular displacement. In this case, the reference is typically the fast-scan motion of the carriage and all printhead nozzle banks are to be aligned relative to that direction. Typically, the nozzle array is set to be perpendicular to the fast-scan direction as determined by the carriage motion although other orientations are possible and sometimes desired. For example, intentional rotation of the nozzle banks can be used to increase the apparent nozzle density of the print head.

The first and most straightforward means to determine the ideal locations is to eject several fiducial marks from nozzles of the reference nozzle bank. By ejecting numerous drops from one or more nozzles of the reference nozzle bank on a single pass of the carriage, the fast-scan direction may be determined relative to the orientation of the digitization process. From this datum most angular displacements may be calculated.

Another feature that can facilitate determination of alignment errors is by taking advantage of the known resolution of the digitization device. This might be determined beforehand by calibration of the digitization device. Once the absolute position of the reference nozzle bank is determined, the expected locations of all other dots may be calculated in a straightforward fashion.

The centroids themselves can also be used to calculate a matrix of ideal locations. If one considers FIG. 8, one notices that the actual printed dots in general fall onto a regular lattice with small deviations from the perfect lattice corners. If the pattern of dots is sufficiently random (i.e., random selection of nozzles and pixel location assignments) and is large enough, acceptable results are obtained by calculating the ideal lattice spacing by averaging spacing between subsequent dot columns and the averaging spacing between subsequent dot rows.

In accordance with a preferred procedure, the following steps may be used to determine ideal locations for centroids using a target printed by the printer:

(a) the reference nozzle bank is first identified;

(b) all dot centroids printed by the reference nozzle bank and by the other nozzle banks are found by scanning of the target using the preferred target scanner;

(c) of those dot centroids in (b) printed by the reference nozzle bank identify those centroids printed by a single nozzle that printed multiple dots in a single pass;

(d) use those dot centroids found in (c) in each set to fit a line; i.e. those centroids printed by the same nozzle of the reference nozzle bank constitute a set of centroids;

(e) determine the slope of the lines determined in step (d) and average the slopes (note this averages media skew relative to the scanner as the target may have some skew relative to the scanning head on the target scanner or image capture device);

(f) rotate the whole field of the dot centroids scanned from the target by the negative of the skew angle determined in step (e), note that this whole field includes dots on the target that had been printed by all the nozzle banks and not just the reference nozzle bank and this rotation adjusts for possible skew between the target and the target scanner head and thus aligns dots printed by the reference nozzle bank in the fast-scan direction with the target scanner;

(g) using the known resolution of the scanner (1/500 inches minimum and preferably 1/3000 inches) fit straight vertical lines through all dots in the slow-scan direction and determine spacing between lines. This is done in software using the scanned in data from scanning of the target. Note that a separate line is fit for each set of "vertical" dots, i.e., the dots that belong to the first vertical line are selected and then fit with a line, the dots that belong to the second vertical line are selected and then fit with a line, etc. Subsequently, the spacing between all those vertical lines is averaged in step (h).

(h) determine the average spacing of the vertical lines found in (g);

(i) define an ideal lattice in the slow-scan direction, assuming that discrete dots have been printed on the target at for example 5 pixel locations apart and the nominal resolution of the printer is 300 DPI then if the target scanner scans the target at 600 DPI the spacing between lines in the ideal lattice will be 10 scanner pixels apart, note also that the lattice can be defined in the fast-scan direction also, for example every 10 scanner pixels, and that ideal lattice locations need not be an integer number of pixels apart;

(j) using the ideal lattice (slow scan direction) found in (i) determine the best fit condition over the dot centroids by shifting the position of the ideal lattice in the slow-scan direction but maintaining the spacing between the lattice lines, this may be best to do using only the centroids of the dots printed by the reference nozzle bank but may be done using the centroids printed by all the nozzle banks, the best fit location condition of the lattice exists where the average spacing of the dots printed on the target to lines on the ideal lattice is the lowest, note that this is repeated in the fast-scan direction;

(k) define coordinate values for all intersections of the x,y ideal lattices;

(l) go to step 212.

Numerous other methods to determine the ideal dot centers will be obvious to those skilled in the art in view of the description provided herein.

In step 212 of FIG. 6, the dot placement error for each dot is determined. Now that the ideal dot centers have been calculated (step 210) and the actual dot centers are known (step 208), this process is simply finding the orthogonal distances between the ideal and actual centers.

Step 214 of FIG. 6, the determination of root causes of alignment error, requires detailed knowledge of the geometry of the printhead and nozzle banks, layout of the carriage, and the Dot-to-Nozzle Map. For example, center-of-rotation of the printhead must be known such that one can estimate the effect of rotation has on the fast-scan and slow-scan errors of each nozzle within the print head. Once codified, this complexity may be completely hidden from the printer operator and results in accurate prescribed adjustments that yield excellent alignment with little or no iteration. The results from these calculations may be simply displayed to the operator and/or stored (step 218), but preferably the adjustments are downloaded directly to the printer, which automatically or semi-automatically makes the prescribed adjustments. In some printers, these adjustments might require actual physical adjustment of the print head or a nozzle bank, which might be done manually or with the assist of electromechanical means governed by the printer. For example, the second nozzle bank used for printing of a first color may be mounted so as to be pivotable or otherwise adjustable relative to the first nozzle bank used for printing the first color. Means for adjustment of nozzle banks or printheads are described in WO 02/087888 A1. Although this publication shows pivoting movement of two nozzle banks, a similar mechanism, such as a cam 33 (see FIG. 12) that can be used to pivot nozzle bank 39B about pin 32, can be provided for adjustment of position of a single nozzle bank relative to the other. Other adjustments, such as the relative alignment of nozzle banks in the fast-scan direction, are easily implemented within the process controller of the printer such as by adjusting firing timing of individual nozzles, in this regard see WO 02/096656 A1. The adjustment of firing timing or mechanical adjustment is considered to be well within the skill of the art after review of the above-cited two international publications. Also, the alignment of the different drop sizes within a nozzle bank can be readily accomplished by simply delaying ejection of faster drops relative to slower drops. All of these adjustments are preferably hidden from the user or operator. It is not uncommon for some printers to require well over 100 alignment adjustments, all of which may be determined with a single target as prescribed in the process of FIG. 6.

Figure 7:
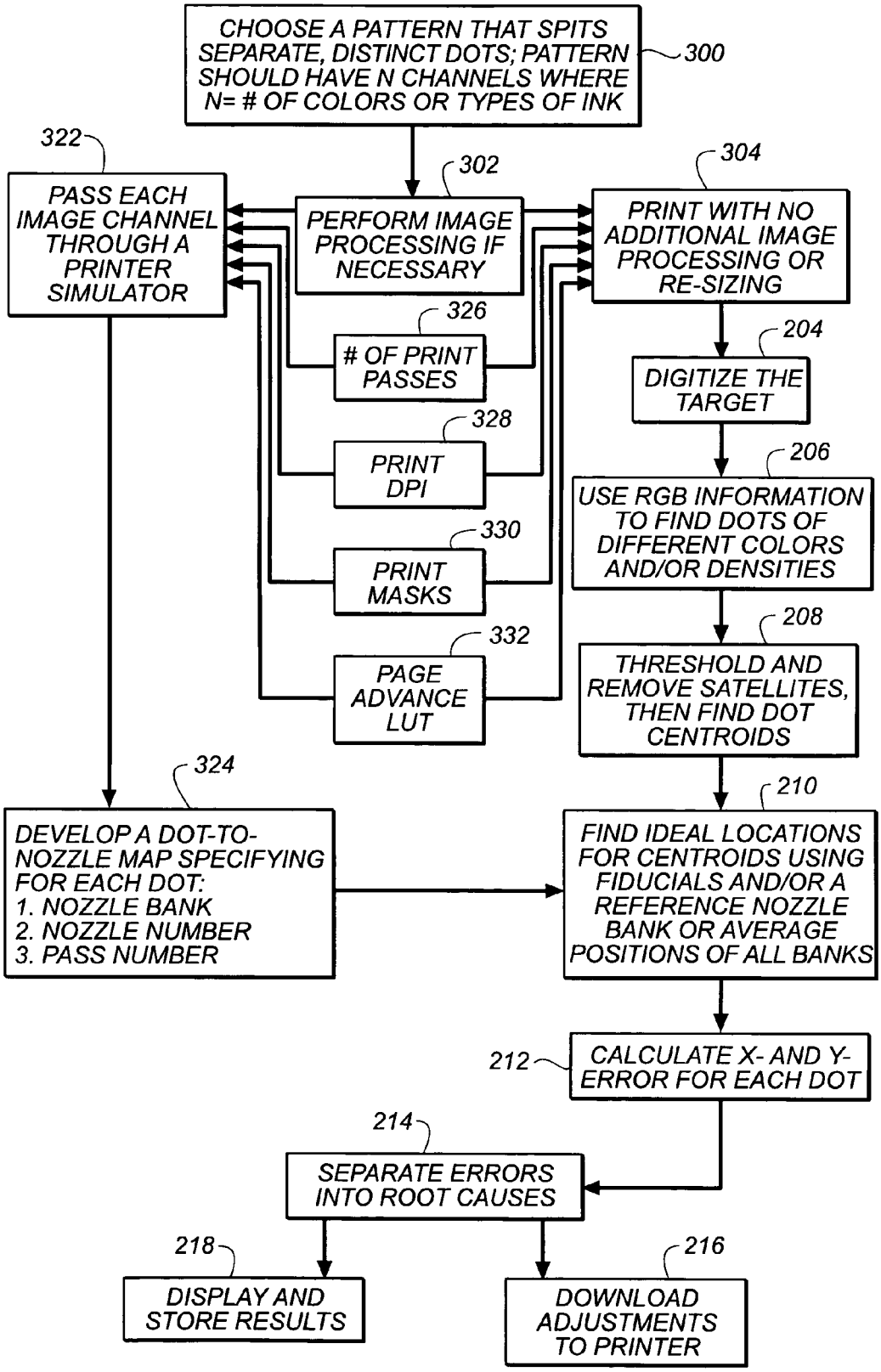
FIG. 7 is a flowchart illustrating steps in a more flexible and generic method of aligning nozzle banks in accordance with this invention in which multiple targets may be used for single print mode or a single digital target may be used with multiple print modes.

An alternative to the process described in FIG. 6 is provided in FIG. 7. The process described in FIG. 6 requires the definition and implementation of a prescribed Dot-to-Nozzle Map. Furthermore, different print modes (such as in regard to number of passes, or printing resolution, print day, page advance) may require different Dot-to-Nozzle Maps if they require different alignment settings, thereby increasing the programming required. A process that does not require this additional programming is described in FIG. 7. In step 300 of FIG. 7, a pattern is defined with N number of channels where N is the number of types of ink within the printer. Each pattern channel is co-designed such that no two channels have an "on" pixel on top of each other or next to each other. This ensures that dots printed by the printer will be separate and distinct. Optionally, additional image processing is performed in step 302. This processing may be the conversion of the pattern from step 300 into an image format, such as TIF, JPEG or other standardized graphic display file format that the printer can understand. A computer may be used to define a pattern of multicolored dots and a TIF or JPEG file generated therefrom which the printer's controller or raster image processor understands and can determine for itself which nozzles print which dots on which pass just as it would do for any other image to be printed.

In step 304 of FIG. 7, the image from step 302 is printed at a mode as specified by elements 326, 328, 330, and 332 of FIG. 7, defining the mode in which the image is printed. Steps 204, 206, 208, 210, 212, 214, 216, and 218 for the process described in FIG. 7 are identical for those same process elements described by FIG. 6.

Step 322 of FIG. 7 accepts the image data from step 302, as well as the print mode specification provided in steps 326, 328, 330, and 332. That is, the print mode specification can be identified from one of plural selectable print pass modes (step 326) used to print a swath, printing resolution (step 328) for example 300, 600 or 1200 DPI, print mask employed (step 330) and page advance LUT or look-up table (step 332) which establishes the receiver media advancement scheme. The processing of step 322 is best described as a simulator that embodies the nozzle geometry in the printer (such as that shown in FIG. 1) along with the means to simulate the printing process. Each image channel from step 302 may be processed separately or jointly, depending upon the architecture of the simulator. If the simulator is an accurate representation of the printing process, the output will be the Dot-to-Nozzle Map of Step 324. The use of a process such as FIG. 7 greatly simplifies the programming required within the printer controller while affording the flexibility of printing many different patterns in numerous print modes such that the most efficient pattern and mode for aligning the printer can be determined.

The processes of FIG. 6 and FIG. 7 can be optimized such that the algorithms run quickly and very little operator interaction is required. Furthermore, these processes can be repeated at different nozzle bank gap settings or different media thicknesses such that the optimal alignment is obtained. These settings may be saved in the printer memory and recalled at a later date when the user returns the printer to the same setup. This technique is also useful for measuring printer assembly variation. For example, the guide member (15 of FIG. 10) along which the carriage rides may not be perfectly straight. These bends may ultimately be demonstrated as varying angular displacements if the measurements described in FIG. 6 or FIG. 7 are repeated at different places along the fast-scan axis. Likewise, the guide member may not be parallel with the printer platen on which the media rests as it travels through the print zone. This will give rise to variations in nozzle bank gap, which is readily apparent from variations in alignment measurements made in different places along the fast-scan axis. This process may also be repeated at different carriage speeds if required.

Although typically not necessary, the processes of either FIG. 6 or FIG. 7 may be repeated iteratively, each iteration giving additional accuracy of alignment.

Figure 16:
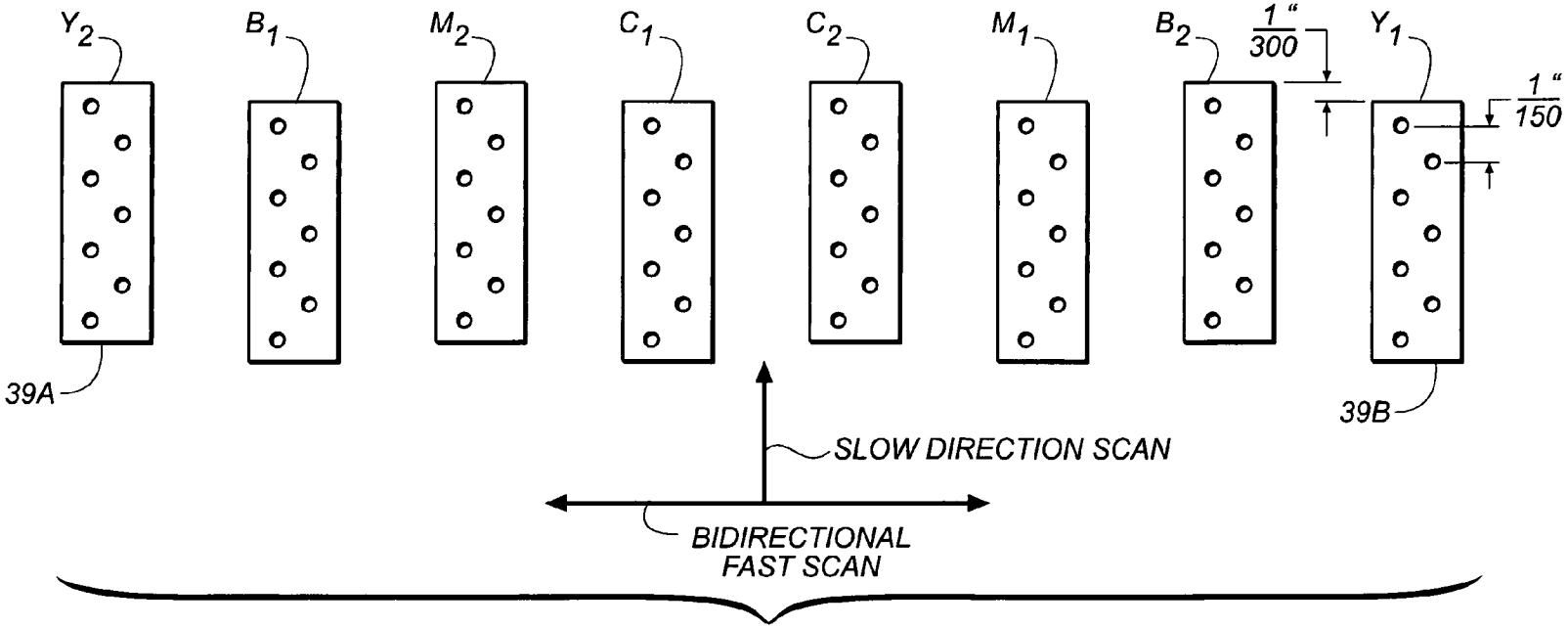
FIG. 16 is an arrangement of nozzle banks that may be used in a color inkjet printer and for which the invention is ideally suited.

With reference to FIG. 16, there is illustrated an arrangement of nozzle banks wherein 8 nozzle banks are provided and mounted on a carriage not shown but which may be similar to that shown in FIG. 10. One group of nozzle banks Y2, M2, C2 and B2 is used to print during movement of the carriage in one of the fast scan directions to print by selectively depositing drops of yellow, magenta, cyan and black inks respectively and the other group of nozzle banks Y1, M1, C1 and B1 is used to print during movement of the carriage in the second of the fast scan directions to print by selectively depositing drops of yellow, magenta, cyan and black inks respectively. Conversely, both sets of nozzle banks may be used in printing either direction, resulting in improved productivity with minimal loss of image quality. It will be noted that the ink used in nozzle banks Y1 and Y2 are the same color and are identical inks. The two nozzle banks Y1 and Y2 are separated by a relatively large distance due to the presence of the other nozzle banks between them. Similarly, the ink used in the magenta color ink emitting nozzle banks M1 and M2 are of the same color and otherwise identical as is the ink used in the cyan color ink emitting nozzle banks C1 and C2 and the black color ink emitting nozzle banks B1 and B2. It will be noted that the arrangement of the nozzle banks provides a symmetry in their arrangement relative to a line parallel to the slow scan direction and that the respective nozzle banks in each of at least three of the nozzle bank pairs (Y1,Y2; B1,B2; M1,M2) are separated by a nozzle bank that emits ink of a different color than that of the respective pair. One group of nozzle banks such as the group comprising Y1,M1,C1,B1 may also be offset in the slow scan direction relative to the other group of nozzle banks by an amount comprising one-half the pitch spacing of nozzles on a nozzle bank. Thus, for a nozzle bank having a nozzle spacing of, for example, 150 nozzles per inch in the slow scan direction, the offsetting may provide for increased resolution to 300 nozzles per inch when the two nozzle banks of the same color ink are used. The arrangement of the different colors shown in FIG. 16 is exemplary however other arrangements of the nozzle banks may be used in accordance with preferences with building up of colored dots on the receiver sheet.

As noted above, the invention may be used in conjunction with alignment of drops from nozzle banks for use in printing liquids other than ink such as printing onto lithographic plates or for printing of conductive patterns or designs onto circuit boards or other substrates or for printing edible dyes onto cakes or pastries or for building up of three-dimensional structures onto substrates. Regardless of whether or not the liquid being printed is ink or some other liquid, the printer emitting or ejecting a liquid from each nozzle may still be referred to as an inkjet printer. Furthermore, the invention is also applicable to printers having banks of light emitter recording elements or thermal recording elements that are to be assembled to form a printhead array.

The invention has been described with particular reference to its preferred embodiments, but it will be understood by those skilled in the art that various changes may be made and equivalents may be substituted for elements of the preferred embodiments without departing from the invention. In addition, many modifications may be made to adapt the particular situation and material to a teaching of the present invention without departing from the essential teachings of the invention.

What is claimed is:

1. A calibration method of aligning the printing of dots by different nozzle banks of an ink jet printer apparatus, the method comprising the steps of:

(a) printing on a receiver medium a sequence of spaced discrete first dots from one nozzle bank having plural nozzles associated therewith, the first dots being printed in a predetermined pattern;

(b) printing on the receiver medium a sequence of spaced discrete second dots from a second nozzle bank having plural nozzles associated therewith, at least some of the second dots being printed within the pattern;

(c) generating through examination of the receiver medium or a reproduction thereof information regarding the dots printed on the receiver medium;

(d) using the information to identify locations of the second dots;

(e) determining placement errors for the at least some of the second dots; and (f) adjusting alignment of the second nozzle bank in accordance with any errors determined in placement wherein in step (c) the receiver medium is scanned at a resolution of at least five times the diameter of the smallest dot printed thereon.

2. The method of claim 1 and wherein the first and second nozzle banks print different color inks.

3. The method of claim 1 and wherein the first and second nozzle banks print the same color ink.

4. The method of claim 1 including digitizing an image of the dots using a digital camera.

5. The method of claim 1 and wherein the first and second nozzle banks move in order to provide dots at different locations on the receiver medium and some of the first and second dots are printed during different passes.

6. The method of claim 5 and wherein error is determined based on information about which nozzle printed which dot on which pass.

7. The method of claim 1 and wherein at least one of the first and second nozzle banks prints ink of different drop sizes.

8. The method of claim 1 and wherein in step (c) a scanner scans the receiver medium at a location separate from a carriage on the printer apparatus.

9. The method of claim 1 and wherein adjustments to the alignment of the second nozzle bank is made automatically in response to determining the placement error.

10. The method according to claim 1 and wherein at least some of second dots printed within a pattern on the recording medium and printed by respective second nozzles in a second nozzle bank are closer to first dots in the pattern and printed by respective first nozzles on the first nozzle bank than the respective nozzle spacings between the second nozzles and the first nozzles.

11. The method according to claim 1 and wherein adjustment of alignment of a bank is made by providing information relative to timing of actuations of recording elements that corrects for alignment error of a bank.

12. The method according to claim 1 and wherein the pixels are scanned by a color scanner to determine pixels of different colors.

13. The method of claim 1 and wherein in step (f) different adjustments of timing of actuations of a nozzle in the second nozzle bank are provided for different drop sizes emitted by that nozzle to correct for alignment errors in the second nozzle bank.

14. The method of claim 1 and wherein the first dots are printed in a different color from the second dots.

15. The method of claim 1 and wherein in step (d) locations of centroids of dots are determined.

16. The method of claim 1 and wherein the first nozzle bank defines reference dot positions of dots printed during a single pass.

17. The method of claim 1 and wherein the first and second nozzle banks emit ink of the same color and both of the first and second nozzle banks are supported on a carriage for movement in the fast scan direction and the first and second nozzle banks are separated in the fast scan direction by additional nozzle banks that emit inks of different colors than said same color.

18. A method of aligning the printing of dots generated by different nozzle banks of an inkjet printer apparatus comprising the steps of:

(a) printing on a receiver medium a sequence of spaced discrete first dots from one nozzle bank having plural nozzles associated therewith;

(b) printing on a receiver medium a sequence of spaced discrete second dots from a second nozzle bank having plural nozzles associated therewith, the second dots being spaced from the first dots and at least some of the second dots being located at distances closer to at least some of the first dots than the respective nozzle spacings between nozzles on the second nozzle bank which emitted the at least some of the second dots and the nozzles on the first nozzle bank that emitted the at least some of the first dots;

(c) determining a placement error for the at least some of the second dots; and (d) adjusting alignment of the second nozzle bank in accordance with any errors determined in placement, wherein steps (a) and (b) and (c) are repeated at different spacings of the nozzle banks to different receiver media.

19. A calibration method of aligning the printing of dots generated by different nozzle banks of an ink jet printer apparatus, the method comprising the steps of:

(a) printing on a receiver medium a sequence of spaced discrete first dots of a first color from one nozzle bank having plural nozzles associated therewith, the first dots being printed in a predetermined pattern;

(b) printing on the receiver medium a sequence of spaced discrete second dots of a second color from a second nozzle bank having plural nozzles associated therewith, at least some of the second dots being printed within the pattern;

(c) generating through examination of the receiver medium or a reproduction thereof color information regarding the dots printed on the receiver medium;

(d) using the color information to identify locations of the second dots;

(e) determining placement errors for the at least some of the second dots; and (f) adjusting alignment of the second nozzle bank in accordance with any errors determined in placement wherein the placement error is examined for possible error in rotation position of the second nozzle bank.

20. The method of claim 19 and wherein the rotation position of the second nozzle bank is determined relative to a predetermined relational point of rotation of the second nozzle bank.

21. A method of aligning the recording of pixels by different recording element banks of a printer apparatus comprising the steps of:

printing on a recording medium a predetermined pattern of discrete spaced pixels by plural recording elements of each of at least first and second banks, each discrete pixel being printed by a single one of the recording elements;

removing the recording medium from the printer apparatus;

examining the recording medium or a reproduction thereof at a resolution of at least 500 DPI to derive electronic information relative to the location of pixels in the printed pattern;

processing the information to determine respective centers of the spaced pixels;

determining errors in location of the determined centers of the spaced pixels from where the centers should be if the banks were properly aligned;

determining needed adjustments of a bank or banks or recording elements in the bank or banks to improve alignment of the pixel recording by such bank or banks or recording elements in the bank or banks; and adjusting alignment of pixel recording by at least one bank or at least some of the recording elements therein in accordance with a determination of needed adjustments wherein in the step of determining needed adjustment of a bank or recording elements therein a signal is provided related to a need for a rotational adjustment of the bank.

22. A method of aligning the recording of pixels by different recording element banks of a printer apparatus comprising the steps of:

printing on a recording medium a predetermined pattern of discrete spaced pixels by plural recording elements of each of at least first and second banks, each discrete pixel being printed by a single one of the recording elements;

removing the recording medium from the printer apparatus;

examining the recording medium or a reproduction thereof at a resolution of at least 500 DPI to derive electronic information relative to the location of pixels in the printed pattern;

processing the information to determine respective centers of the spaced pixels;

determining errors in location of the determined centers of the spaced pixels from where the centers should be if the banks were properly aligned;

determining needed adjustments of a bank or banks or recording elements in the bank or banks to improve alignment of the pixel recording by such bank or banks or recording elements in the bank or banks; and adjusting alignment of pixel recording by at least one bank or at least some of the recording elements therein in accordance with a determination of needed adjustments wherein in the step of adjusting alignment of pixel recording by at least one bank or at least some of the recording elements therein alignment adjustment is made by pivoting the bank.

* * * * *